US012214249B2

(12) United States Patent
Cohen et al.

(10) Patent No.: US 12,214,249 B2
(45) Date of Patent: Feb. 4, 2025

(54) PORTABLE RESISTANCE-BASED EXERCISE MACHINE AND SYSTEM

(71) Applicant: Pilata, Inc., San Antonio, TX (US)

(72) Inventors: Matthew Cohen, San Antonio, TX (US); Daniel Husserl, Santa Barbara, CA (US); Heather Dorak, San Antonio, TX (US); Alexander Prodromos Gilbert, Austin, TX (US)

(73) Assignee: PILATA, INC., San Antonio, TX (US)

( * ) Notice: Subject to any disclaimer, the term of this patent is extended or adjusted under 35 U.S.C. 154(b) by 0 days.

(21) Appl. No.: 18/338,575

(22) Filed: Jun. 21, 2023

(65) Prior Publication Data

US 2023/0330478 A1 Oct. 19, 2023

Related U.S. Application Data

(63) Continuation of application No. 18/064,104, filed on Dec. 9, 2022, now Pat. No. 11,717,719.
(Continued)

(51) Int. Cl.
*A63B 22/20* (2006.01)
*A63B 21/00* (2006.01)
(Continued)

(52) U.S. Cl.
CPC ..... *A63B 22/203* (2013.01); *A63B 21/00069* (2013.01); *A63B 21/0442* (2013.01);
(Continued)

(58) Field of Classification Search
CPC ..... A63B 21/072; A63B 21/0442; A63B 21/0552; A63B 21/154; A63B 21/4034;
(Continued)

(56) References Cited

U.S. PATENT DOCUMENTS 2,131,570 A * 9/1938 Riley ..... A63B 21/154 482/106
2,632,645 A 3/1953 Barkschat
(Continued)

FOREIGN PATENT DOCUMENTS

WO 2021089144 A1 5/2021

OTHER PUBLICATIONS

"Balanced Body Allegro Reformer," Balanced Body, https://www.pilates.com/store/pilates-equipment/reformers/allegro-pilates-reformer (last visited: Dec. 9, 2022).
(Continued)

*Primary Examiner* — Andrew S Lo
(74) *Attorney, Agent, or Firm* — Perilla Knox & Hildebrandt LLP; Kenneth A. Knox

(57) ABSTRACT

An exercise system that may be rail-less, frameless, and/or portable is described. The exercise system includes a carriage having a plurality of wheels and a stationary platform. The stationary platform is independent of and separate from the carriage, and is freestanding. A tension member having a first end is attached to the carriage and a second end is detachably attached to the stationary platform such that the carriage is movable on a horizontal plane parallel to a ground surface while the stationary platform remains in a fixed position. The carriage and the stationary platform have a width suitable for performing various exercises.

21 Claims, 26 Drawing Sheets

Related U.S. Application Data

(60) Provisional application No. 63/330,101, filed on Apr. 12, 2022, provisional application No. 63/288,189, filed on Dec. 10, 2021.

(51) Int. Cl.
*A63B 21/04* (2006.01)
*A63B 24/00* (2006.01)
*A63B 71/00* (2006.01)
*A63B 71/06* (2006.01)

(52) U.S. Cl.
CPC ..... *A63B 21/153* (2013.01); *A63B 21/4033* (2015.10); *A63B 24/0062* (2013.01); *A63B 71/0036* (2013.01); *A63B 71/0619* (2013.01)

(58) Field of Classification Search
CPC ..... A63B 2208/0204; A63B 2071/027; A63B 21/0414; A63B 21/4043; A63B 23/03525; A63B 23/1209; A63B 21/4035
See application file for complete search history.

(56) References Cited

U.S. PATENT DOCUMENTS 3,584,871 A * 6/1971 Kelmon, Jr. ..... A63B 21/0552 482/123
4,132,404 A * 1/1979 Wilson ..... A63B 22/20 482/146
4,225,132 A * 9/1980 Archambault ..... A63B 22/20 482/125
6,071,217 A * 6/2000 Barnett ..... A63B 21/154 482/121
6,120,423 A 9/2000 Mackey et al.
6,500,105 B1 * 12/2002 Kuo ..... A63B 21/00043 482/910
6,733,428 B2 * 5/2004 List ..... A63B 21/0552 482/121
6,746,383 B2 * 6/2004 Yu ..... A63B 21/015 482/123
7,104,937 B2 9/2006 Arbuckle et al.
7,125,369 B2 10/2006 Endelman
7,677,988 B2 * 3/2010 McMillan ..... A63B 69/3661 473/266
7,803,095 B1 9/2010 Lagree
7,931,570 B2 * 4/2011 Hoffman ..... A63B 21/055 482/129
9,744,400 B2 8/2017 Cole
9,868,010 B2 1/2018 Lagree et al.
10,022,577 B2 7/2018 Lagree et al.
10,155,129 B2 12/2018 Lagree et al.
10,512,814 B1 12/2019 Conroy
10,561,896 B2 2/2020 Lagree et al.
10,792,528 B1 10/2020 Lagree et al.
10,912,982 B2 2/2021 Lagree
11,179,615 B1 11/2021 Lagree
11,213,719 B1 1/2022 Lagree
D946,094 S 3/2022 Lagree
11,318,340 B1 5/2022 Lagree et al.
11,383,143 B2 7/2022 Lagree
D959,580 S 8/2022 Lagree
11,465,007 B2 10/2022 Duong et al.
11,465,011 B1 10/2022 Lagree et al.
2009/0247376 A1 10/2009 Merrithew et al.
2011/0183822 A1 7/2011 Merrithew et al.
2012/0283079 A1 11/2012 Solow et al.
2014/0141948 A1 5/2014 Aronson et al.
2021/0106864 A1 4/2021 Duong et al.

OTHER PUBLICATIONS

"Balanced Body Allegro 2 Reformer," Balanced Body, https://www.pilates.com/store/pilates-equipment/reformers/allegro2-pilates-reformer/ (last visited: Dec. 9, 2022).
International Search Report and Written Opinion for International Application No. PCT/US2022/081286 mailed Mar. 9, 2023.

* cited by examiner

FIG. 11
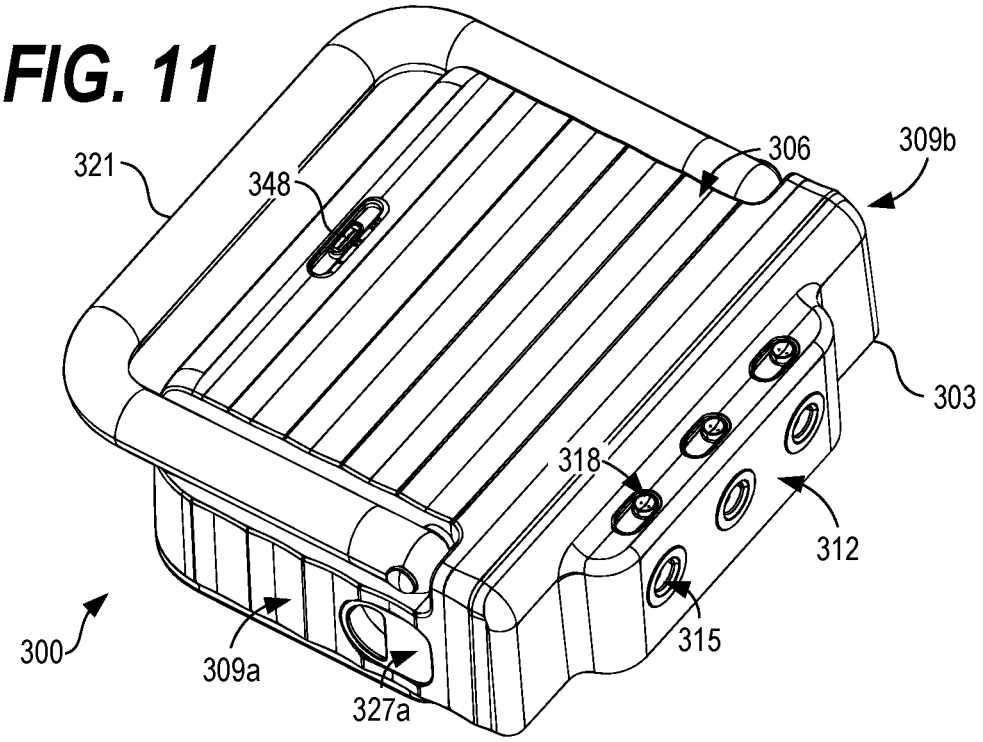
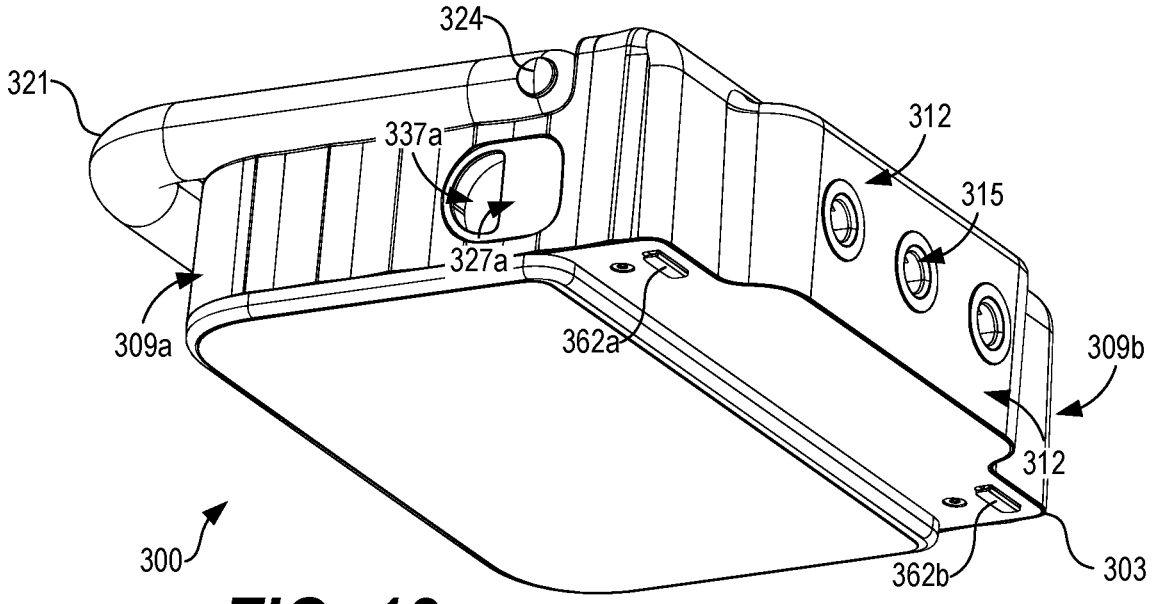
FIG. 12

PORTABLE RESISTANCE-BASED EXERCISE MACHINE AND SYSTEM

CROSS-REFERENCE TO RELATED APPLICATIONS

This application claims the benefit of and priority to U.S. patent application Ser. No. 18/064,104 filed Dec. 9, 2022 entitled "PORTABLE RESISTANCE-BASED EXERCISE MACHINE AND SYSTEM," which claims priority to U.S. Provisional Application No. 63/288,189 filed Dec. 10, 2022 entitled "PORTABLE, RESISTANCE-BASED EXERCISE MACHINE," and U.S. Provisional Application No. 63/330,101 filed Apr. 12, 2022 entitled "MAT FOR USE WITH A PORTABLE, RESISTANCE-BASED EXERCISE MACHINE," the contents of all of which being incorporated by reference in their entireties herein.

TECHNICAL FIELD

The present disclosure relates to exercise apparatuses for use in Pilates-type exercises and other exercises. More particularly, the present disclosure relates to a frameless and rail-less rolling apparatus used to perform various muscle strengthening exercises including, but not limited to, Pilates-type exercises.

BACKGROUND

Various exercise machines exist from treadmills to rowing devices to Pilates reformers (herein "reformers"). In Pilates, exercises are performed by an exerciser by moving a slidable carriage moveably connected to an elevated frame that along rails of a generally rectangular reformer having two ends. The slidable carriage slides along two side rails, extending from a first end to a second end, to translate the slidable carriage from the first end to the second end. One or more springs create a workload against which therapeutic or fitness exercises can be safely and beneficially performed.

The frame and rail system serve as the foundation for the reformer. However, reformers are expensive, elaborate, large, heavy, and difficult to transport and store. The major reason for this deficiency is the dependency on the frame and rail system. The frame and associated rails typically are at least six feet (1.8288 m) in length, where most are in the seven to ten foot range, which makes it difficult to create a portable version of a reformer.

BRIEF SUMMARY

Various embodiments for a portable, resistance-based, and frameless exercise system and/or machine are described. In a first aspect, an exercise system is described that includes a carriage comprising a plurality of wheels and at least one tension member having a first end coupled to the carriage and a second end comprising a tension member connector; a platform, the platform being independent of and separate from the rolling carriage, wherein the platform comprises: a first cable extension arm accessible on a first side of the platform, and a second cable extension arm accessible on a second side of the platform; a first retractable cable having a first end coupled to the first cable extension arm and a second end coupled to a first spinning cable spool, and a second retractable cable having a first end coupled to the second cable extension arm and a second end coupled to a second spinning cable spool; and at least one platform aperture on a front face of the platform facing the carriage, wherein the tension member connector is configured to be coupled to the at least one platform aperture, forming a coupling between the carriage and the platform.

In some aspects, the platform further comprises a resistance selection switch that, when manipulated, adjusts a resistance delivered by at least one of the first spinning cable spool and the second spinning cable spool. The platform further comprises at least one release switch configured to dislodge the tension member connector from the at least one platform aperture. The exercise system further includes a stowage dock comprising a plurality of wheels configured to store the carriage and the platform therein in a vertical side-by-side arrangement, for example.

In some aspects, the exercise system further includes at least one computing device and a display device, the at least one computing device being in communication with at least one sensor of the exercise system, the at least one computing device being configured to display information associated with measurements performed by the exercise system using the at least one sensor on the display device.

In some aspects, the exercise system includes a guide mat that is foldable, the guide mat comprising a first track formed of metal configured to retain a first portion of the plurality of wheels of the carriage and a second track formed of metal configured to retain a second portion of the plurality of wheels of the carriage, wherein other portions of the guide mat are formed of a non-metallic material.

In a second aspect, an exercise system that is rail-less, frameless, and portable is described that includes: a carriage movable between a first position to a second position; at least one tension member coupled to the carriage, the at least one tension member comprising at least one tension member connector; and a platform independent of and separate from the carriage, the platform comprising at least one platform connector configured to couple to the at least one tension member connector to form a tensioned coupling between the carriage and the platform, wherein the at least one tension member is adapted to impose a tensioning force such that the carriage is movable on a horizontal plane parallel to a ground surface while the platform remains stationary in a fixed position.

In some aspects, the at least one tension member is a plurality of tension members. Each of the plurality of tension members comprises an elongated spring body configured to deliver the tensioning force. The tension member connector comprises a base and an extending member extending from the base, wherein the base has a diameter greater than that of the extending member. The extending member comprises an annular recess that couples the extending member to a cord tip, wherein the platform comprises a projection that is configured to engage the annular recess, thereby maintaining a connection between the platform and the carriage via the at least one tension member.

In some aspects, the exercise system includes a first cable device and a second cable device, wherein the first cable device is accessible from a first platform side of the platform and the second cable device is accessible from a second platform side of the platform. The first cable device includes a first cable extension arm, a first retractable cable, and a first spinning cable spool, the first retractable cable having a first end coupled to the first cable extension arm and a second end coupled to the first spinning cable spool, and the second cable device comprises a second cable extension arm, a second retractable cable, and a second spinning cable spool, the second retractable cable having a first end coupled to the second cable extension arm and a second end coupled to the second spinning cable spool.

In some aspects, the platform further includes a resistance selection switch that, when manipulated, adjusts a resistance delivered by at least one of the first spinning cable spool and the second spinning cable spool, and a release switch configured to dislodge the tension member connector from the at least one platform aperture connector. The first cable extension arm and the second cable extension arm are configured to be disposed within a respective platform side such that an end of the first and second cable extension arm is flush with the respective platform side. The first cable extension arm and the second cable extension arm are configured to be popped or otherwise pulled out of the platform.

In some aspects, the platform further comprises a coupling member positioned on a rear face of the platform opposite of a side facing the carriage, the coupling member being a rod having a recessed portion for receiving an attachment device. The carriage further comprises a plurality of wheels, and the exercise machine further comprises a guide mat that is foldable, the guide mat comprising a first track configured to retain a first portion of the plurality of wheels of the carriage and a second track configured to retain a second portion of the plurality of wheels of the carriage.

In some aspects, the exercise system further includes a stowage dock comprising a plurality of wheels configured to store the carriage and the platform therein, wherein the stowage dock is configured to store the carriage and the platform therein in a vertical side-by-side arrangement. A top surface of at least one of the carriage, the platform, and the stowage dock is formed of a ribbed material suitable for providing friction during exercise.

In a third aspect, an exercise system is described that includes a carriage movable between a first position to a second position via a movement device; at least one tension member coupled to the carriage, the at least one tension member comprising a tension member connector; a platform independent of and separate from the carriage, the platform comprising at least one platform connector configured to couple to the tension member connector to form a tensioned coupling between the carriage and the platform; and a guide mat configured to ensure alignment of the carriage during translation of the carriage relative to the guide mat.

In some aspects, the guide mat includes at least one track that retains the movement device, thereby ensuring the alignment of the carriage during the translation of the carriage relative to the guide mat. The guide mat comprises a first elongated aperture positioned on a first side of a top mat surface and a second elongated aperture positioned on a second opposing side of the top mat surface. The first elongated aperture and the second elongated aperture are rectangular shaped, and the first elongated aperture and the second elongated aperture are encapsulated by a body of the guide mat.

In some aspects, the movement device of the carriage comprises a plurality of wheels, and the guide mat comprises a first track positioned in the first elongated recess configured to retain a first portion of the plurality of wheels of the carriage, and a second track positioned in the second elongated recess configured to retain a second portion of the plurality of wheels of the carriage. The at least one tension member is a plurality of tension members, and each of the plurality of tension members comprises an elongated spring body configured to deliver a predetermined force. A body of the guide mat comprises a folding notch extending substantially along the body such that the body of the guide mat is foldable along the folding notch. The guide mat comprises a proximal end and a distal end, the platform configured to be positioned at the proximal end; the first track comprises a first mat tab exposed on a bottom surface of the guide mat, and the second track comprises a second mat tab exposed on the bottom surface of the guide mat; and the first mat tab and the second mat tab project inwards towards a distal end of the guide mat.

In some aspects, the platform includes a first platform tab and a second platform tab projecting from a bottom surface of the platform towards a direction opposite that of the platform front. In some aspects, the first platform tab is configured to hook and form an interference connection with the first mat tab of the guide mat, and the second platform tab is configured to hook and form an interference connection with the second first mat tab of the guide mat. In some aspects, the exercise system includes a linear guide that projects from the guide mat or telescopes from the platform, wherein the carriage is movably coupled to the linear guide it to move between a proximal end of the linear guide to a distal end of the linear guide and in return.

In additional aspects, methods are described of providing one of the foregoing exercise systems, or components thereof, and/or manufacturing one of the foregoing exercise systems, or components thereof.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIGS. 11-12 are perspective views of a platform for use with the exercise machine in accordance with various embodiments of the present disclosure.

DETAILED DESCRIPTION

An exercise system and machine for performing resistance-based exercises in prone, reclined, sitting, standing positions, and the like is described, particularly useful in performing muscle strengthening exercises including, but not limited to, Pilates-type exercises. The exercise system and machine may generally comprise various independent components, namely, a movable or rollable carriage that glides on a mat or directly on a floor, and a standalone, stationary platform. In additional embodiments, a stowage dock may be provided for storage of the aforementioned components as well as associated accessories.

In some exercise scenarios, the carriage and the stationary platform may be connected by one or more tension members which may be housed at least partially in the carriage. The tension members may be selectively attached to the platform to provide resistance to the movement of the carriage with respect to the platform. In other scenarios, no resistance may be needed and, as such, no tension members are required. The exercise machine is portable and easy to stow, providing increased utilization of space. Further, the exercise machine is meant to be a space saving evolution of the traditional Pilates reformer which has a large and cumbersome frame and rail system.

Figure 1:
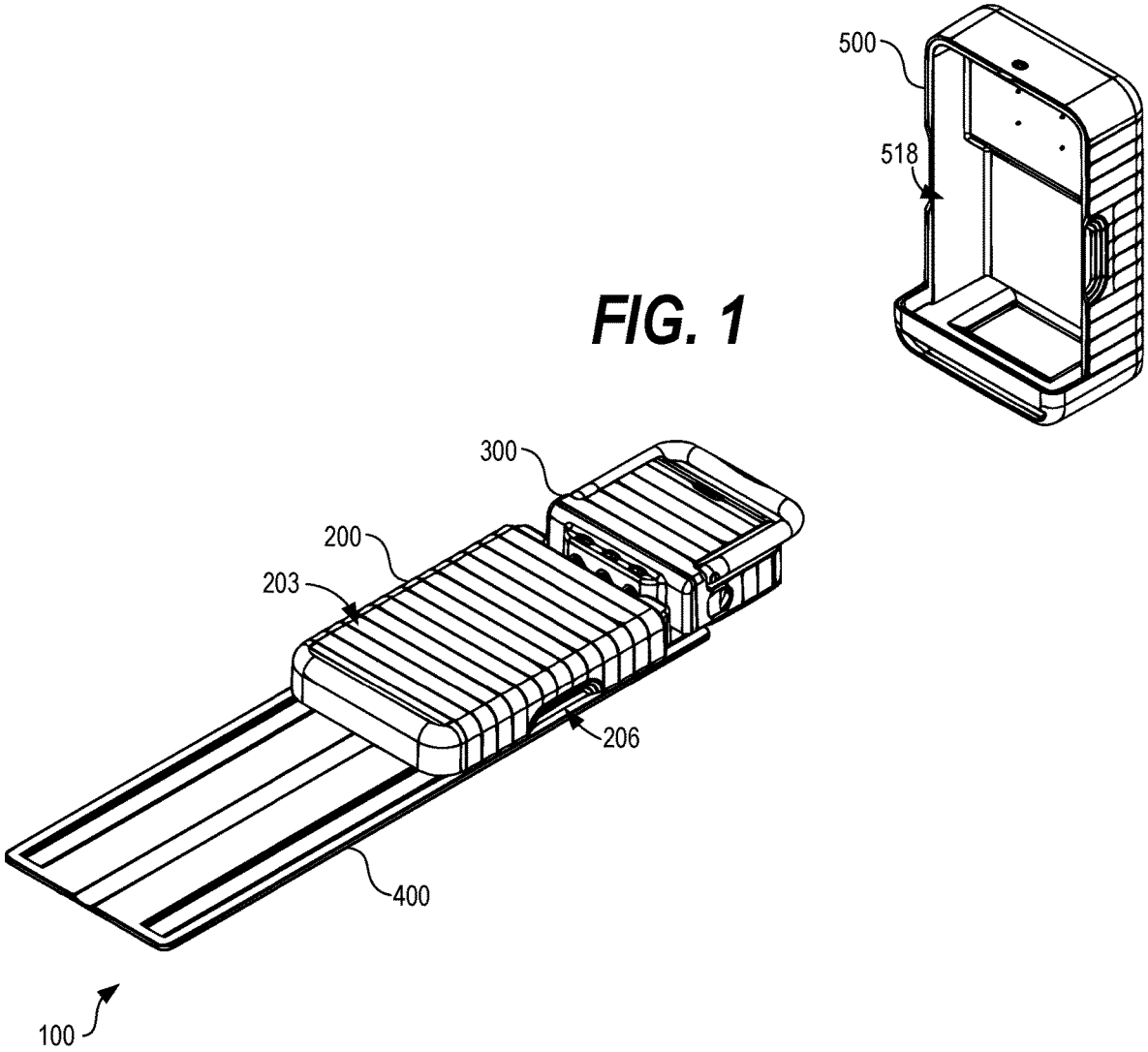
FIGS. 1 and 2 are top perspective views of an example of an exercise machine in accordance with various embodiments of the present disclosure.
Figure 2:
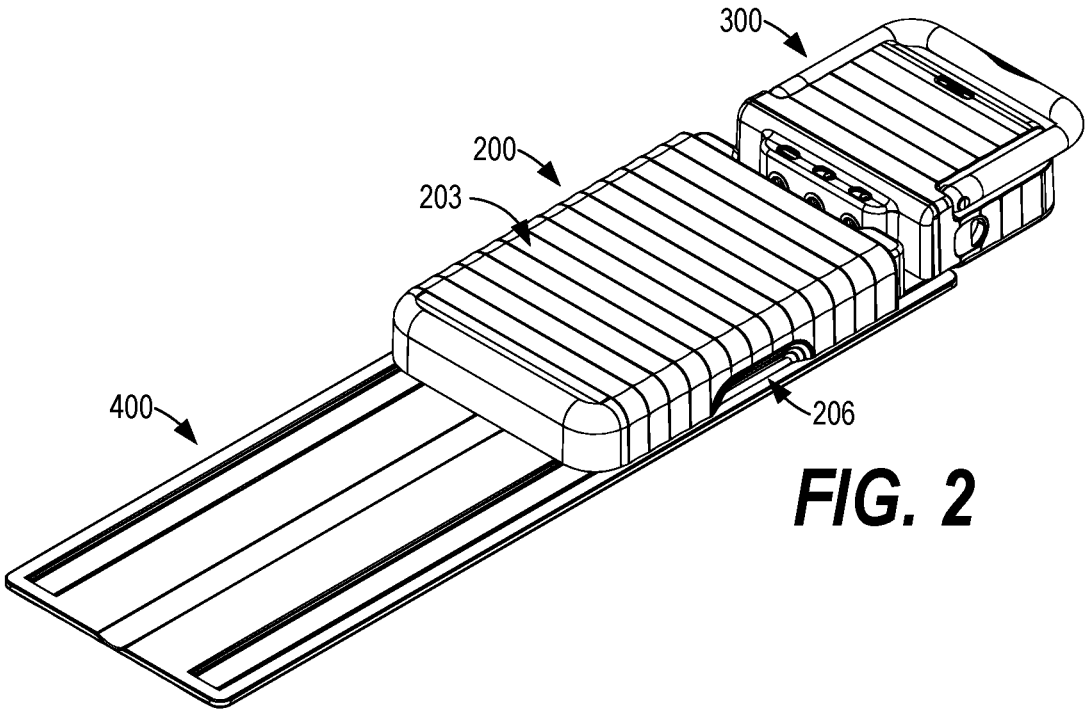
Figure 3:
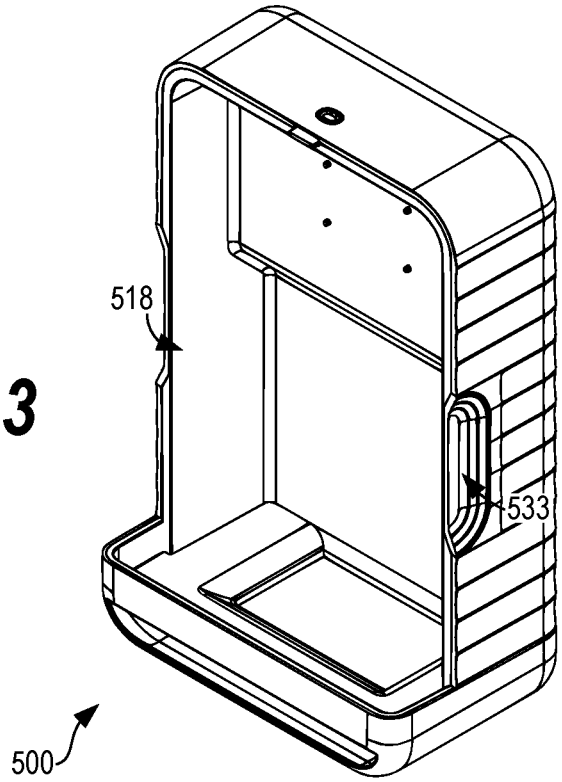
FIGS. 3-5 are various views of a stowage dock for use with the exercise machine in accordance with various embodiments of the present disclosure.

Turning now to the drawings, FIG. 1 shows a top perspective view of a non-limiting example of an exercise system 100 (or "exercise machine" or "reformer"). The exercise system 100 may include a carriage 200, a stationary platform 300 (or "platform 300"), a guide mat 400, a stowage dock 500, and any combination thereof. FIG. 2 shows an enlarged view of a portion of the exercise system 100, namely, the carriage 200, the platform 300, and the guide mat 400, whereas FIG. 3 shows an enlarged perspective view of the stowage dock 500. Referring to FIGS. 1-3 collectively, as compared to conventional reformers, the exercise system 100 does not include rails, reformer frames, and the like, and is thus portable and lightweight. In other words, the exercise system 100 is rail-less, frameless, and transportable. As the exercise system 100 does not include a rail or a frame, as is common in traditional reformers, it is easily movable from one room to another.

Figure 4:
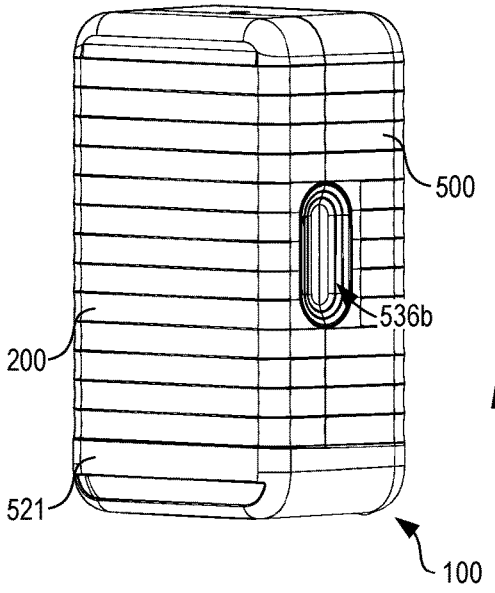
Figure 5:
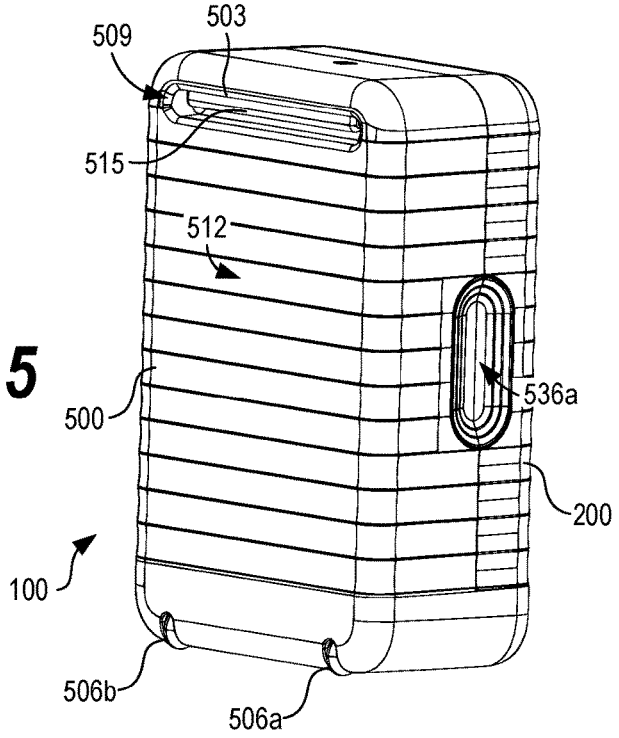

FIGS. 4 and 5 show front and rear perspective views of the carriage 200 and/or the stationary platform 300 docked within or otherwise assembled with the stowage dock 500, thereby forming a single body useful for movement from one location to another. It is understood that, in some implementations, the stowage dock 500 may further store the guide mat 400, cords, bands, cables, cable arms, handle attachments, and other components.

Generally, the stowage dock 500 includes a handle 503 and wheels 506*a*, 506*b* to facilitate rolling or other movement of the stowage dock 500 and any components stored therein. In some embodiments, the handle 503 includes a recessed portion 509 on a rear face 512 of the stowage dock 500 having an ergonomic projection 515 therein that facilitates gripping. A top surface 203, as shown in FIGS. 1 and 2 among others, of the carriage 200, when positioned vertically relative to a ground surface (in a not in use orientation) and nested within a recessed area 518 of the docking state, may be flush with and coplanar with a front surface 521 of the stowage dock 500.

Figure 6:
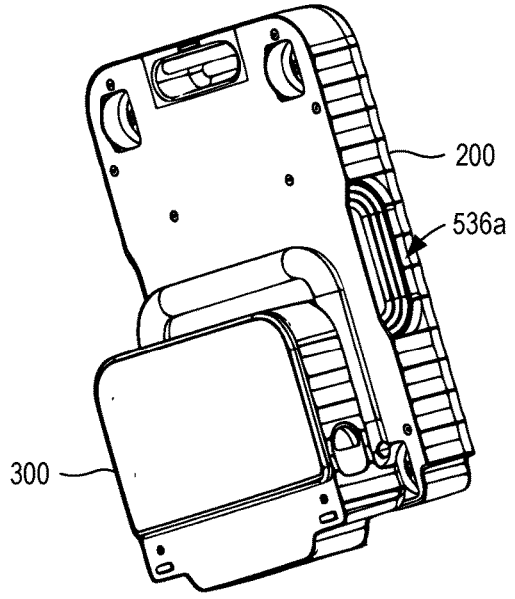
FIG. 6 is a perspective view of a carriage and a platform in a stacked arrangement for storage in a stowage dock in accordance with various embodiments of the present disclosure.

FIG. 6 shows the stowage dock 500 hidden for explanatory purposes to show the arrangement of the carriage 200 and the platform 300 when stowed in the stowage dock 500. Notably, the carriage 200 and the platform 300 are in a side-by-side vertically-stacked arrangement positioned parallel to one another, where the recessed area 518 of the stowage dock 500 is contoured to receive at least one of the carriage 200 and the platform 300. As such, the carriage 200 and the platform 300 may be nested within the recessed area 518 of the stowage dock 500.

Referring back to FIGS. 1-5 collectively, the carriage 200 may include handle areas 206 and the stowage dock 500 may include handle areas 533 that are similarly sized, but oppositely arranged. As such, when positioned sideways and nested within a recessed area 518 of the stowage dock 500, the carriage 200 and the stowage dock 500 together define mated side handles 536*a*, 536*b* (collectively "mated side handles 536") on opposing sides of the assembled body. The mated side handles 536 may be symmetrical, as shown in FIGS. 4 and 5. However, the handle areas 206 may facilitate movement of the carriage 200 independent of the stowage dock 500 and, likewise, the handle areas 533 of the stowage dock may facilitate movement of the stowage dock 500 independent of other components.

Figure 7:
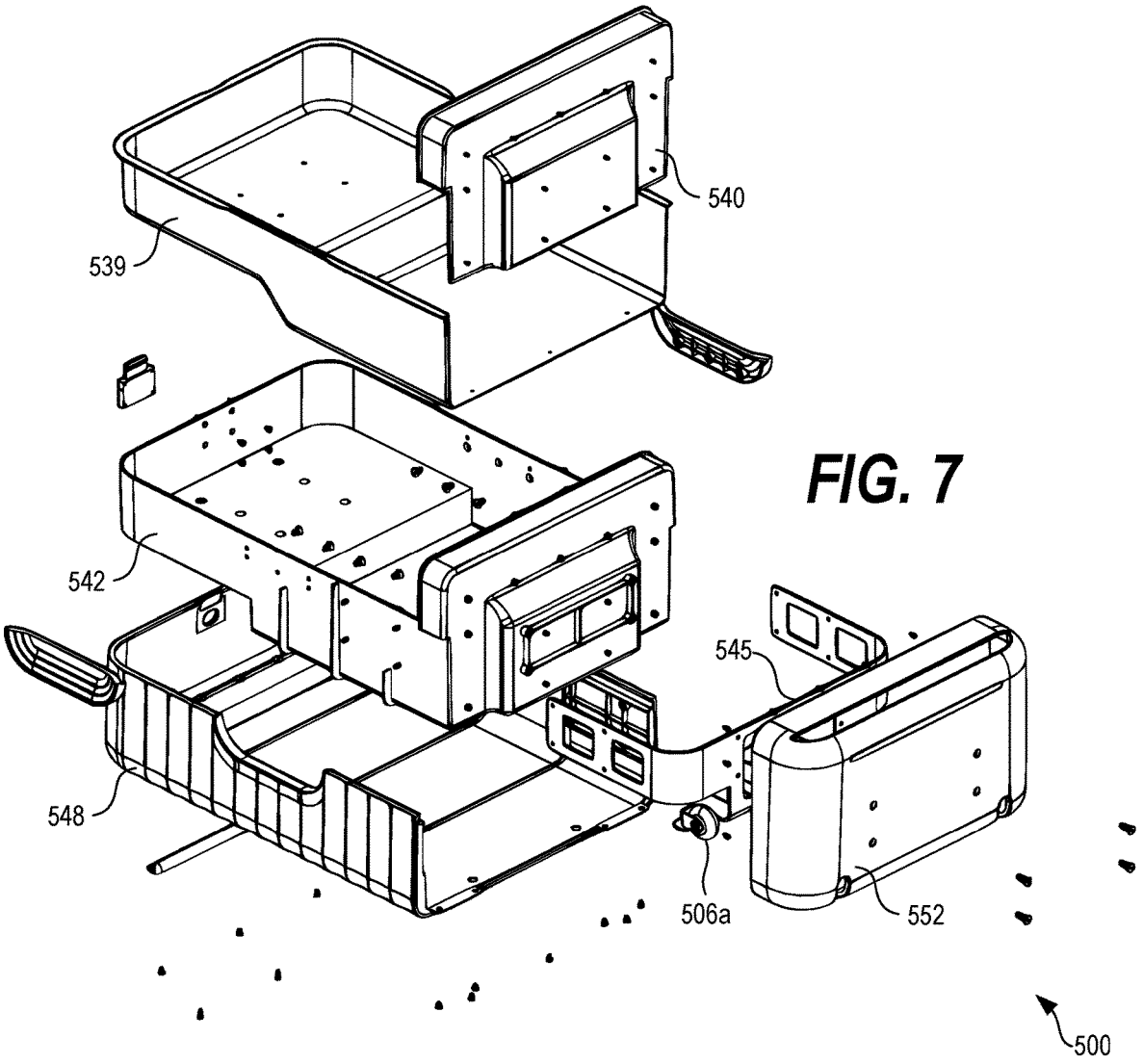
FIG. 7 is an exploded perspective view of the stowage dock for use with the exercise machine in accordance with various embodiments of the present disclosure.

Referring again to the stowage dock 500, an exploded view of the stowage dock 500 is shown in FIG. 7. The stowage dock 500 may be formed of a top shell 539, a top shell insert 540, an intermediary shell 542, a wheel frame 545, a skin cover 548, and a base shell 552 in the arrangement shown in FIG. 7 or like manner. The wheels 506 of the stowage dock 500 may be rotatably mounted to the wheel frame 545, which provides rigidity to at least the bottom portion of the stowage dock 500. The skin cover 548 may provide a ribbed texture, similar to that on top surfaces of the carriage 200 and platform 300, which may facilitate gripping and movement of the stowage dock 500 and any components stored therein.

Figure 8:
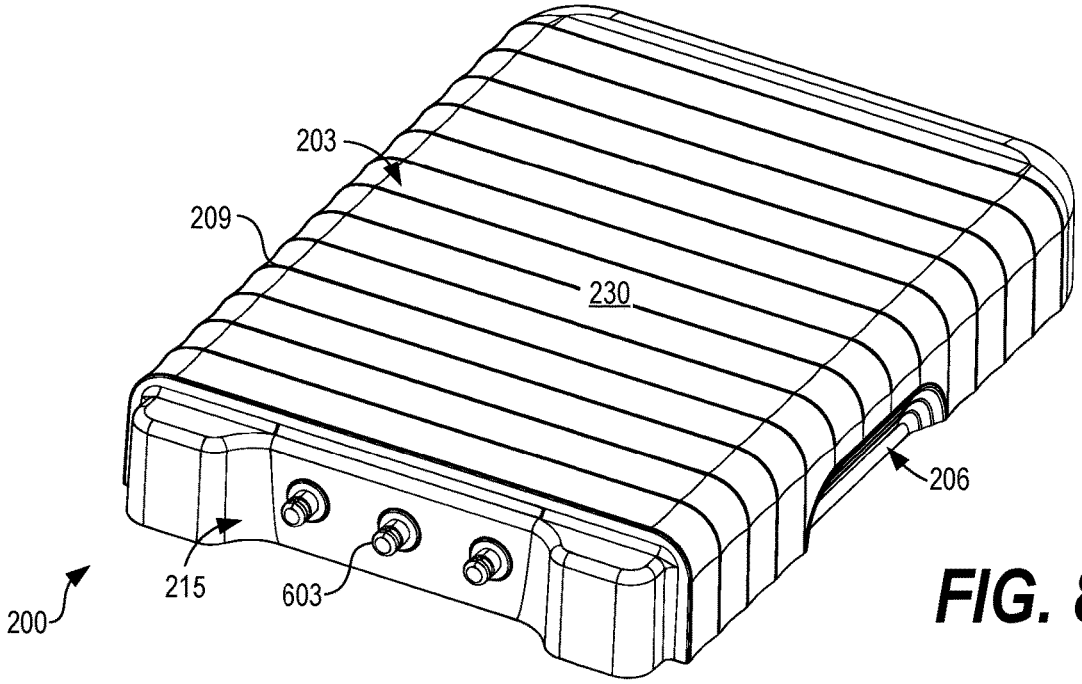
FIGS. 8-9 are perspective views of a carriage for use with the exercise machine in accordance with various embodiments of the present disclosure.
Figure 9:
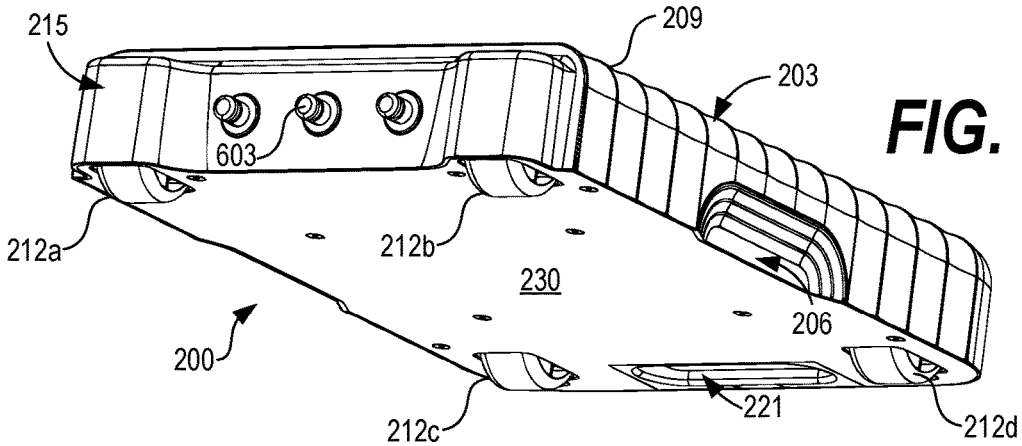

Referring now to the carriage 200, front and rear perspective views of the carriage 200 are shown in FIGS. 8 and 9, respectively. The top surface 203 of the carriage 200, like an exterior surface of the stowage dock 500, may include a ribbed texture formed up of a multitude of ribs 209 to provide an exerciser with adequate friction. In addition to the top surface 203, the carriage 200 may include one or more wheels 212*a* . . . 212*d* (collectively "wheels 212") and, as such, the carriage 200 may be referred to as a movable or a rollable carriage in some embodiments. The wheels 212 may include a traditional type of wheel 212, as shown in FIG. 9, or may be substituted with a continuous-track wheel system, gliders, single wheel implementations, or the like, as may be appreciated. To this end, movement of the carriage 200 is not limited to the type of the wheels 212 shown in the figures. The wheels 212 may be mounted or otherwise positioned on distal ends of the carriage 200 in some embodiments, and/or may be nested or partially nested within the body of the carriage 200. For instance, a majority of the wheels 212 are shown as being substantially nested within a housing of the carriage 200 in FIG. 9 while a portion (e.g., 25%-33%) of the wheel 212 is exposed below a bottom surface of a housing 230 of the carriage 200. A suitable portion of the wheel 212 may be exposed to engage with tracks of the guide mat 400, as will be described, without the guide mat 400 contacting a bottom surface of the carriage 200. The wheels 212 may be preselected such that the carriage 200 has as little friction as possible, providing a near frictionless device.

Further, in some embodiments, the wheels 212 may be selected such that wheels 212 are configured to engage with and roll on a synthetic surface, such as the guide mat 400 or tracks thereof, although other surfaces, such as generic floors (e.g., hardwood floors, tile floors, carpet, etc.) may be utilized by placement of the platform 300 and the carriage 200 directly on the floor (e.g., without use of the guide mat 400). Further, the design of the carriage 200 (e.g., axle placement, rotation of the wheels 212, and so forth) are selected to avoid physical conflicts when performing exercises such that a body part, tension member 600, or other device does not contact any of the wheel 212. In some embodiments, the wheels 212 may be include hubs and caps. While FIG. 9 illustrates the carriage 200 as having four wheels 212, it is understood that other numbers of wheels 212 may be employed.

Figure 10:
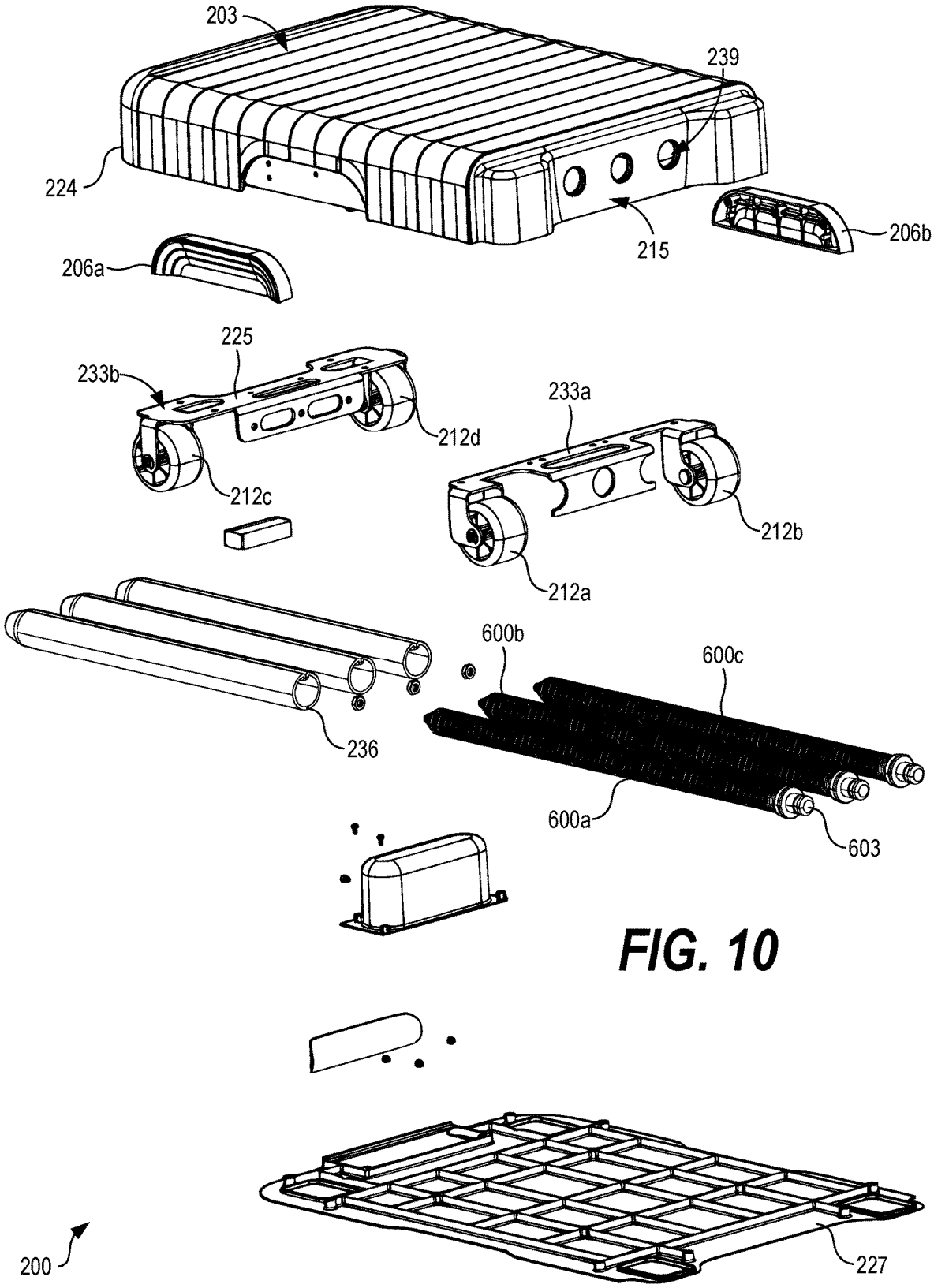
FIG. 10 is an exploded perspective view of the carriage for use with the exercise machine in accordance with various embodiments of the present disclosure.

Referring to FIG. 10, an exploded view of the carriage 200 is shown. As may be seen in FIG. 10, one or more tension members 600*a* . . . 600*c* (collectively "tension members 600") may be stowed in the carriage 200 in some implementations. An individual may partially remove or otherwise access a tension member 600 from a cord aperture 239, stowage compartment, or other access area to utilize the carriage 200 and the platform 300, as will be described, and may restow the tension member 600 in the cord aperture 239 after use.

When stowed in the carriage 200, the tension members 600 may each be positioned in a respective member housing 236 positioned parallel to one another, for example, in an interior of the carriage 200. Each member housing 236 may include a generally tubular hollow member, as shown in FIG. 10, having an open proximal end and a closed tapered distal end. Each tension member 600 may be of a specified design to deliver a predetermined force and, in some implementations, each tension member 600 has the same elasticity or stiffness and, in other implementations, each tension member 600 has a varying elasticity or stiffness.

Each of the tension members 600 may include a tension member connector 603 disposed on one or more ends thereof that is configured to engage with a corresponding connection device (e.g., a receptacle, hook, or the like) on either the carriage 200 or the platform 300 (or, in some embodiments, a receptacle on the guide mat 400) and form a connection therewith. In some implementations, the tension member connector 603 may include threads for forming a threaded connection (e.g., in a screw-like manner), projections and recesses for forming an interference connection (e.g., as shown in FIGS. 10 and 37), and the like, and the tension member 600 may include tension member connectors 603 on one or both sides thereof in various implementations.

Figure 37:
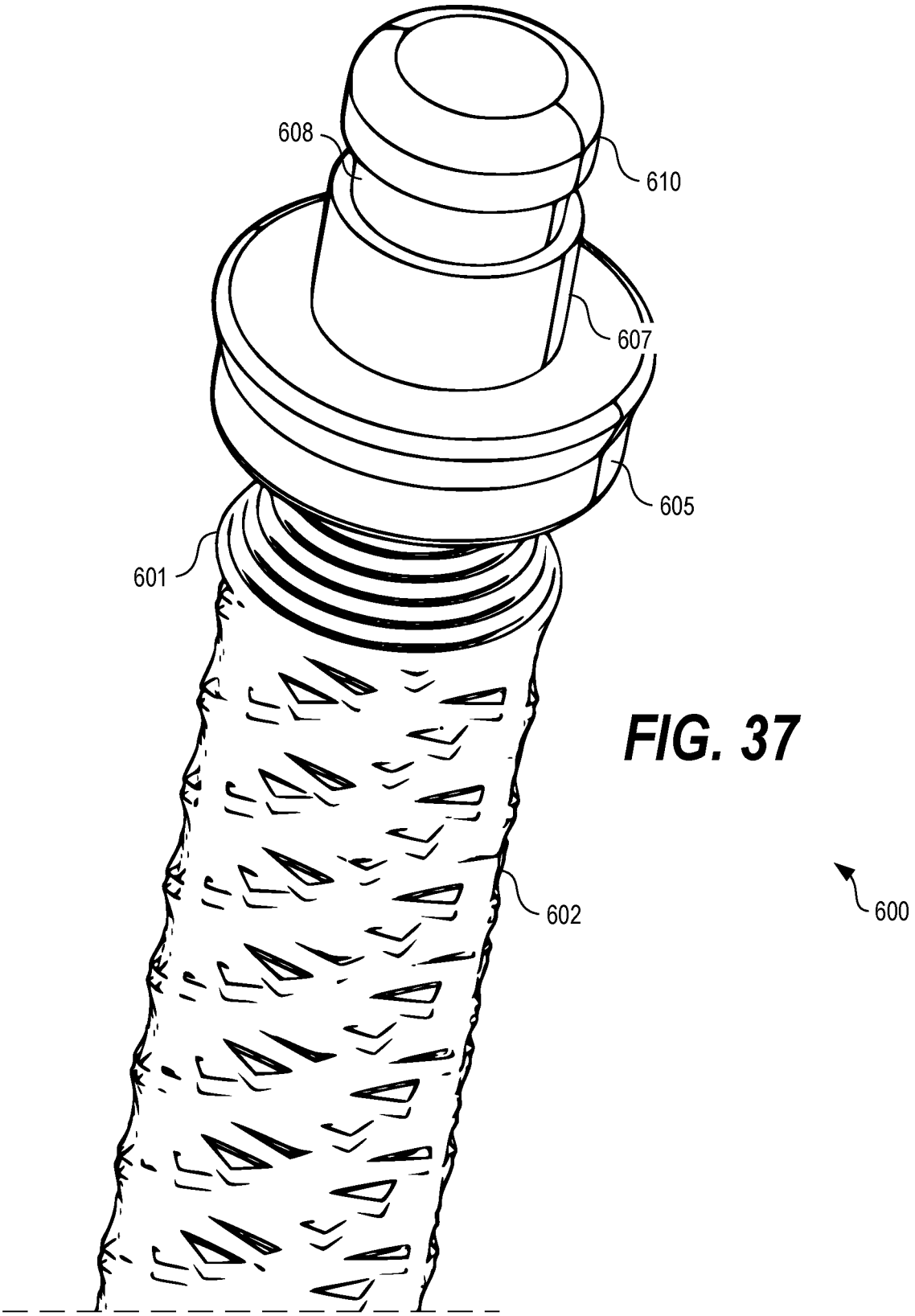
FIG. 37 is an enlarged perspective view of a tension member and a tension member connector thereof in accordance with various embodiments of the present disclosure.

Jumping ahead to FIG. 37, an enlarged view of the tension member 600 is shown according to various embodiments. The tension member 600 includes an elongated spring body 601. The elongated spring body 601 may be at least partially wrapped in a sheath material 602 in some embodiments. The tension member 600 may be formed to deliver a predetermined force, as may be appreciated. The tension member connector 603 may include a base 605 and an extending member 607 projecting vertically from the base 605. The base 605 may have a diameter greater than that of the spring body 601 of the tension member 600, for example. Likewise, the extending member 607 may have a diameter less than that of the base 605. The extending member 607 may include an annular recess 608 that couples the extending member 607 to a cord tip 610.

To connect the tension member 600 to the platform 300, or to the carriage 200 for example, the extending member 607 may be inserted into a suitable aperture (e.g., cord aperture 239) having a projection therein that engages the annular recess 608, thereby maintaining a connection between various components of the exercise system 100. It is understood, however, that the tension member connector 603 may be replaced with other desirable connectors to form a hook-and-loop fastener connection, a threaded connection, a magnetic connection, an interference connection, and so forth between the platform 300 and the carriage 200.

While various embodiments described herein describe a tension member 600 with a spring body, the disclosure is not so limited. In various embodiments, the tension member 600 may include an elastic band (e.g., a fitness band), a bungee cord, and so forth. In some embodiments, the tension members 600 may be made of any material that has elasticity or tension, and that is configured to repeatedly stretch and recover shape quickly when the stretching force or pressure is removed.

Referring back to FIGS. 8-9, the carriage 200 may further include a front face 215 having one or more tension member connectors 603 positioned thereon and projecting therefrom, where portions of the tension member 600 other than the tension member connectors 603 may be disposed within an interior of the carriage 200. For instance, only the tension member connectors 603 may project from the front face 215, whereas the rest of the tension member 600 may be stored in the interior of the carriage 200. In alternative embodiments, however, the one or more tension members 600 may be stowed underneath the carriage 200 as opposed to being stowed inside the carriage 200. As shown in FIGS. 8 and 9, the tension member connectors 603 may include projections that are configured to couple the tension member connector 603 to another component, for instance, to create a coupling and tension between the platform 300 (that remains stationary) and the carriage 200. In some embodiments, the tension member connector 603 are configured to form a threaded connection with one another to avoid the tension member connector 603 being dislodged, but, in alternative embodiments, interference connections, hook-and-loop connection, magnetic connections, and the like may be employed.

The carriage 200 may include handle areas 206 on one or more sides thereof. In addition to handle area 206 disposed on sides of the carriage 200, the carriage 200 may include a bottom surface handle 221. The bottom surface handle 221 may further facilitate movement of the carriage 200, as may be appreciated. As such, the bottom surface handle 221 may include a recessed portion disposed in the bottom surface of the carriage 200 that is ergonomically contoured to a hand grip.

FIG. 10 shows an exploded view of the carriage 200 although not all features are necessarily shown for explanatory purposes. The carriage 200 may include an upper shell 224 and a lower shell 227 that together form a housing 230 of the carriage 200. The top surface 203 of the carriage 200 may be, more specifically, the top surface of the upper shell 224, for example. The wheels 212 may be mounted to wheel brackets 233*a*, 233*b* (collectively "wheel brackets 233"), where the wheel brackets 233 may be disposed within the housing 230, for instance, between the upper shell 224 and the lower shell 227. The wheel brackets 233 may include a frame that couples wheels 212 disposed on opposite sides of the carriage 200 via a coupling member 225. Each wheel bracket 233 may couple two wheels 212, for example. While various embodiments described herein relate to the carriage 200 having wheels 212, in other embodiments, the carriage 200 may include another movement device that enables the carriage 200 to translate or otherwise move. For instance, the wheel bracket 233 and wheels 212 may be replaced with glides (e.g., nylon glides), tank treads, a single wheel mechanism, and so forth.

One or more tension members 600 may be stowed in the housing 230 of the carriage 200, for instance, between the upper shell 224 and the lower shell 227. While various embodiments show the tension members 600 stowed in the housing 230, in other embodiments, the tension members 600 may be stored below the housing 230 or laterally with respect to the housing 230 (e.g., on a side of the housing 230). When stowed in the carriage 200, for instance, the tension members 600 may each be positioned in a respective member housing 236 positioned in at least a partially elongated and parallel arrangement in an interior of the carriage 200, facilitating an easy removal of the tension member 600 from the interior of the carriage 200 or other storage location.

In some embodiments, a first end or portion of the tension member 600 may be fixedly attached to the carriage 200 (or, in other words, non-removable), whereas a second end or portion of the tension member 600 is movable through cord apertures 239 of the carriage 200. As such, the second end of the tension member 600 may be pulled through the cord apertures 239 to couple the tension member 600 to the platform 300 or other desired component, for example. This may facilitate rolling, sliding, or like movement of the carriage 200 along the wheels 212 (e.g., back and forth) with respect to the platform 300, which may be stationary.

In some embodiments, as shown in FIGS. 8, 9, and 10, the tension member connector 603 may have a size greater than the cord apertures 239 of the carriage 200, such that an interference is formed between the tension member connector 603 and the carriage 200, and the tension member connector 603 projecting from the front face 215 of the carriage, permitting the tension member connector 603 to be easily grabbed and manipulated. The tension member 600, when coupled between the platform 300 and the carriage 200, may direct the carriage 200 to translate from a first end of the guide mat 400 to a second end of the guide mat 400, where an exerciser may exert force to translate the carriage 200 from the second end of the guide mat 400 to the first end of the guide mat 400, or vice versa. It is understood that the amount of force required to translate the carriage 200 may depend on the characteristics of the tension members 600 in use.

Figure 13:
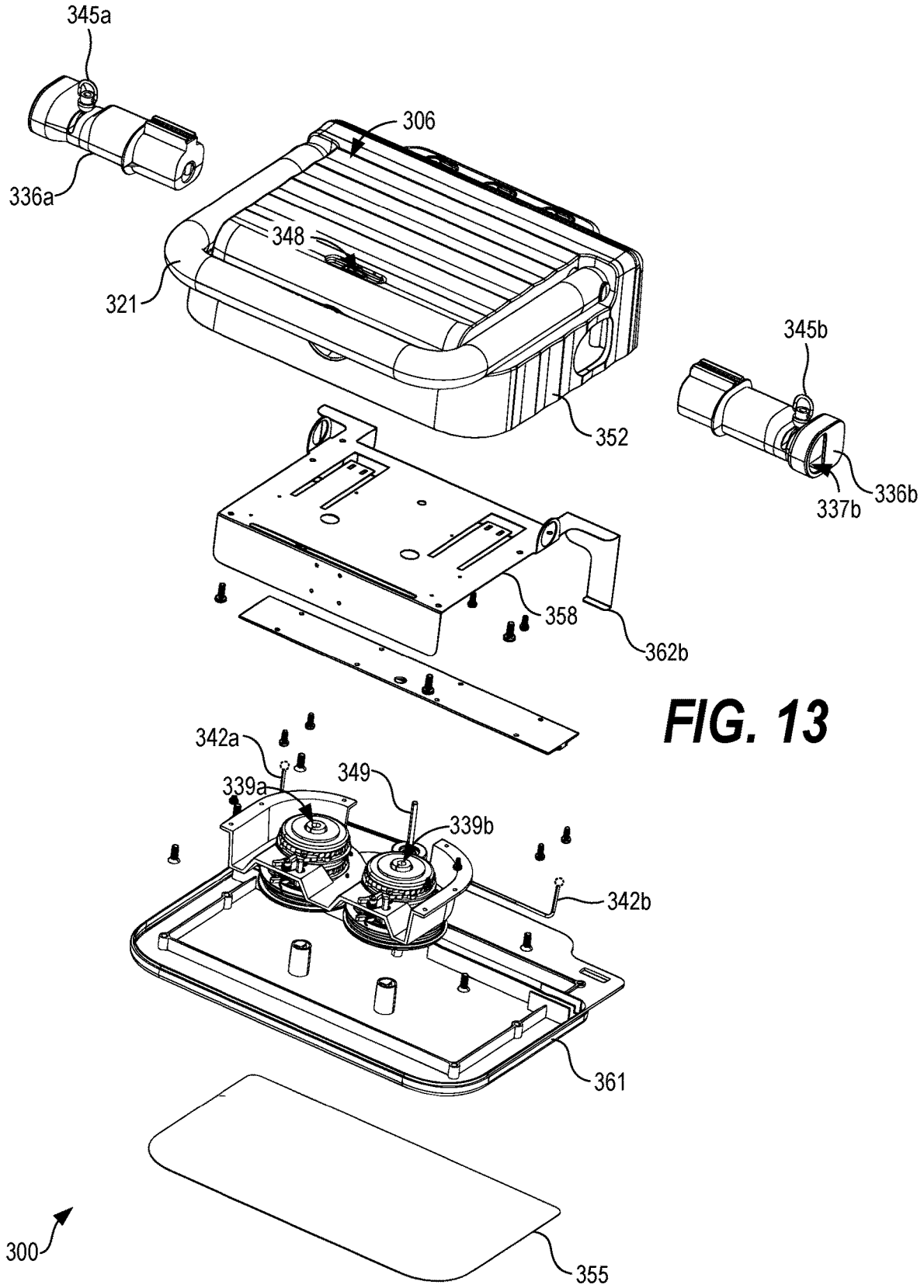
FIG. 13 is an exploded perspective view of the platform for use with the exercise machine in accordance with various embodiments of the present disclosure.

Turning now to FIGS. 11 and 12, a top perspective view and a bottom perspective view of the platform 300 are shown, respectively, according to various embodiments. Also, FIG. 13 shows an exploded view of the platform 300 for additional reference. Generally, the platform 300 may be independent of and separate from the carriage 200. As such, the platform 300 may be a freestanding component and, in some embodiments, may be weighted and/or anchored to the floor (e.g., via suction cups, high-friction bottom surface, and the like) or the guide mat 400 to avoid movement during exercise. In some embodiments, the platform 300 has a width generally the same as or substantially similar to a width of the carriage 200. In various embodiments, in order to facilitate transportability and portability of the exercise system 100, the platform 300 may have a weight equal to or between five and thirty pounds, although other suitable weights may be employed.

The platform 300 may include a platform housing 303 having a top surface 306. The platform 300 may further include platform sides 309*a*, 309*b* (collectively "platform sides 309") and a platform front 312 adapted to face the carriage 200. The platform front 312 may include one or more connection mechanisms for securing a tension member 600 between the platform 300 and the carriage 200. For example, platform apertures 315, as but one example of a connection mechanism, may be provided that are configured to receive a tension member 600, such as one extending from the carriage 200, to form a coupling or a mechanical connection between the carriage 200 and the platform 300. For instance, the platform 300 may include a female-type aperture configured to receive a male-type tension member connector 603, although it is understood that other connection mechanisms may be employed without departing from the scope of the present disclosure.

In some embodiments, the tension member connector 603 and the platform apertures 315 may form a snap connection although other types of connections may be employed. In lieu of a platform aperture 315, in some embodiments, the platform 300 may include a hook, a magnet, hook-and-loop fastener, or other connection device suitable for retaining the tension member 600 and a connection between the platform 300 and the carriage 200 associated therewith.

In various embodiments, to detach a tension member 600 from the platform 300, the platform 300 may include one or more release switches 318. The release switches 318 may be in a one-to-one correspondence with a number of tension members 600 and platform apertures 315, and may include a mechanical device that physically contacts the tension member 600 (or the tension member connector 603) to dislodge the snap connection, permitting the tension member 600 to be retracted into the carriage 200 or otherwise removed. The release switches 318 may be slidable within a switch recess, as shown in the enlarged view of FIG. 19. While various figures included herein show the carriage 200, the stowage dock 500, and the platform 300 configured for use with three tension members 600, it is understood that one, two, three, four, five, etc. tension members 600 may be employed in other implementations.

Figure 41:
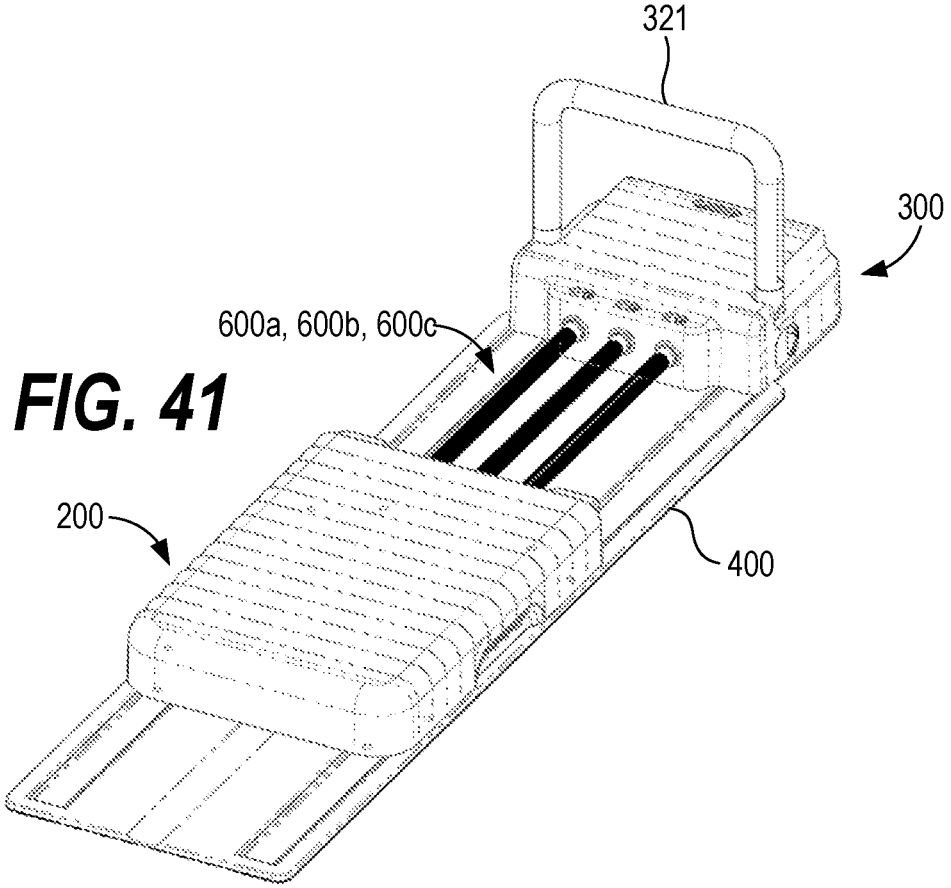
Figure 42:
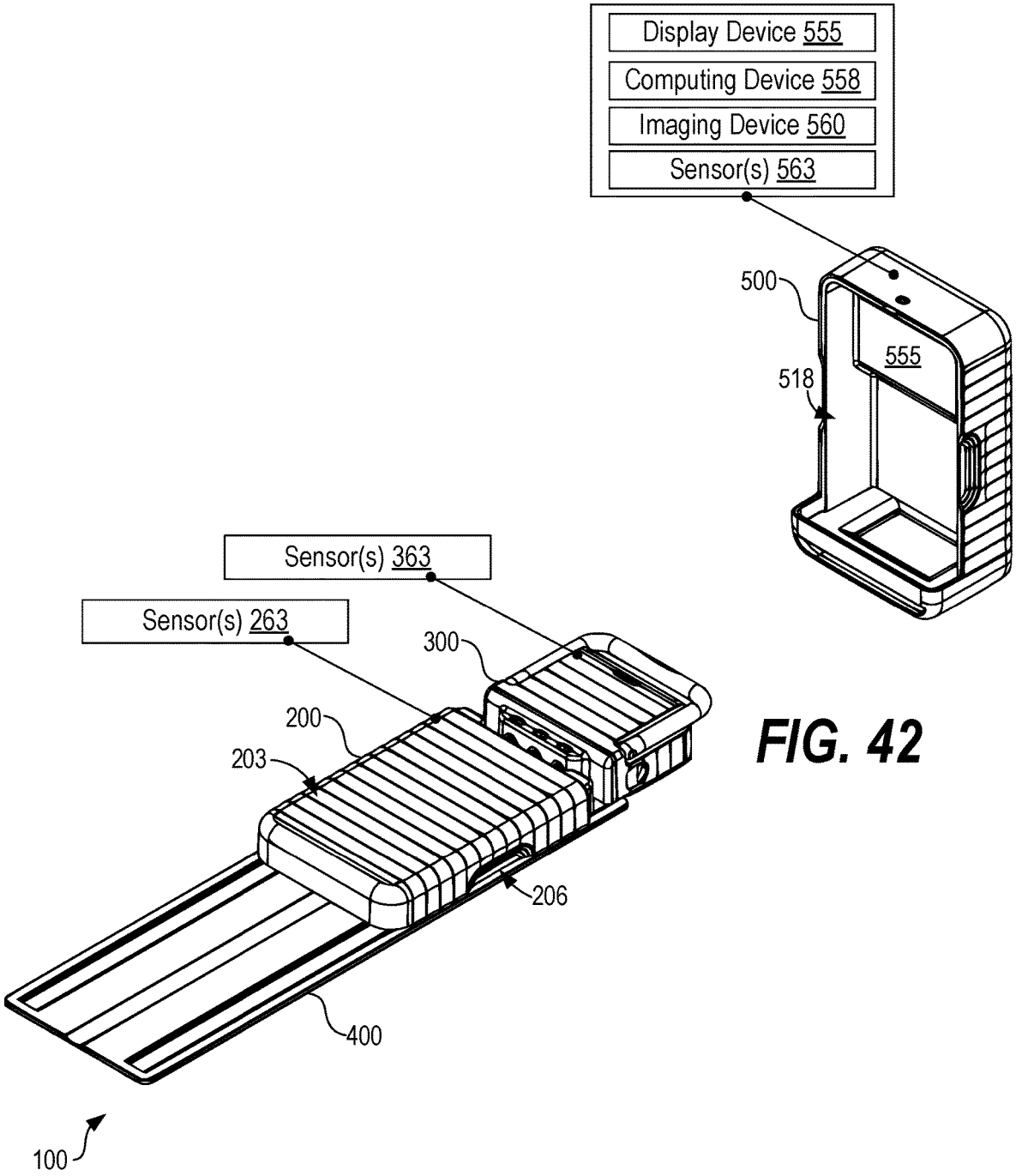

In the non-limiting example of FIGS. 11-13, each of the release switches 318 are positioned proximate to a platform aperture 315 on a top surface 306, whereas the platform apertures 315 are on a platform front 312. Further, the platform 300 may include a handlebar 321 that is pivotable with respect to a handlebar pivot point 324. As such, the handlebar 321 may facilitate transport of the platform 300 which, in some implementations, may have considerable weight. Additionally, when the handlebar 321 is pivoted to an upright position, as shown in FIG. 41, it may be used for various exercise movements, such as push-ups and so forth. Like the carriage 200, the platform 300 may include a ribbed surface texture such that individuals placing hands, feet, or other body parts on the platform 300 have a notable amount of friction. It is understood, however, that alternative surface textures may be employed.

Referring to the exploded view of the platform 300 shown in FIG. 13, in various embodiments, the platform 300 may include a first cable device 327*a* and/or a second cable device 327*b*, which may enable pulley-style exercises to be performed using the platform 300. The first cable device 327*a* may be accessible on the first platform side 309*a*, whereas the second cable device 327*b* may be accessible from the second platform side 309*b*.

Figure 14:
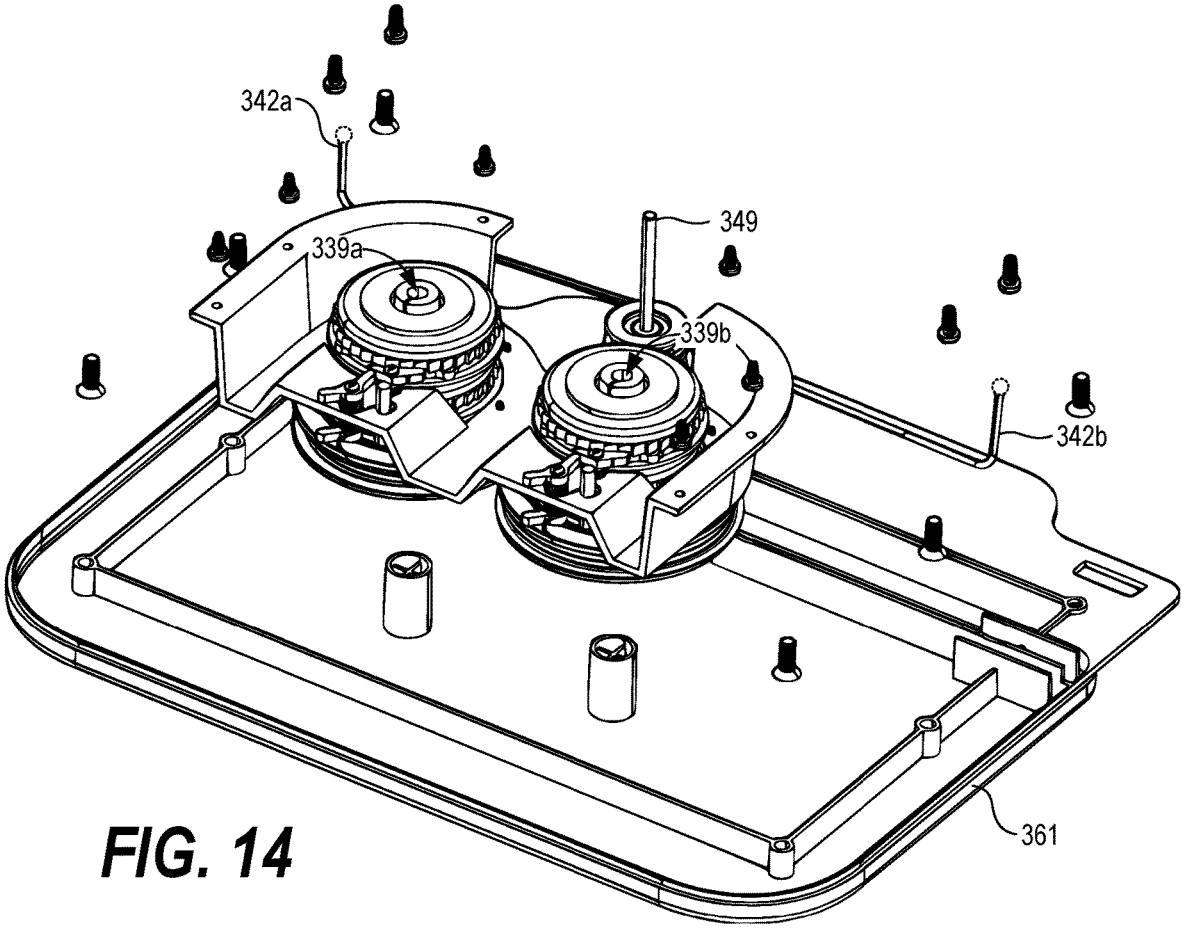
FIG. 14 is an enlarged exploded perspective view of spinning cable spools of the platform for use with the exercise machine in accordance with various embodiments of the present disclosure.
Figure 39:
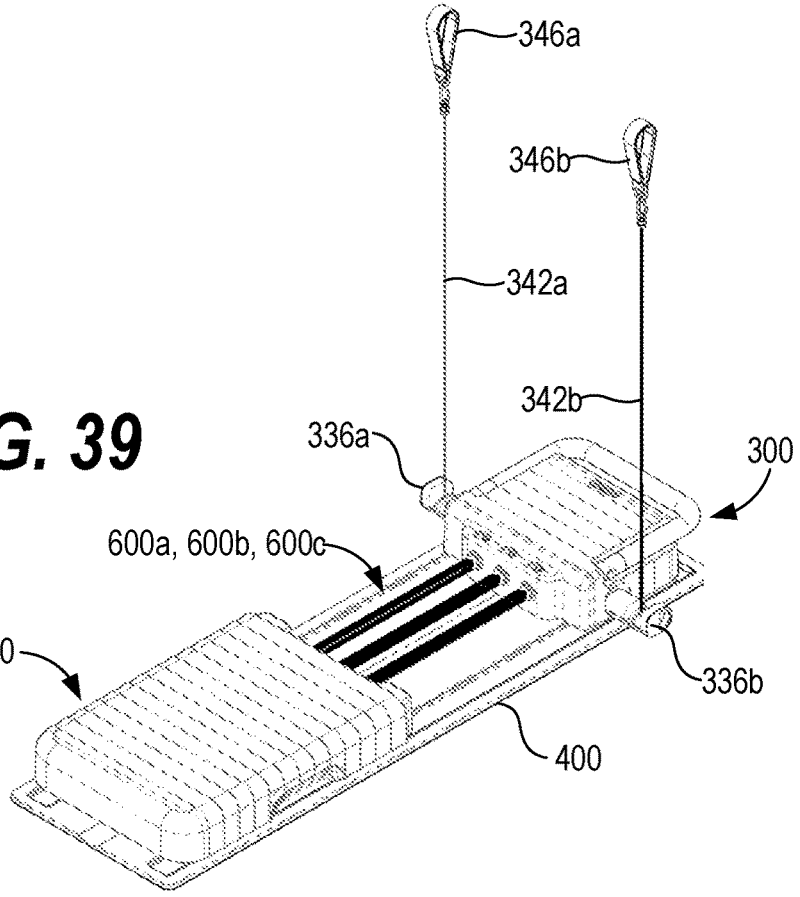
Figure 40:
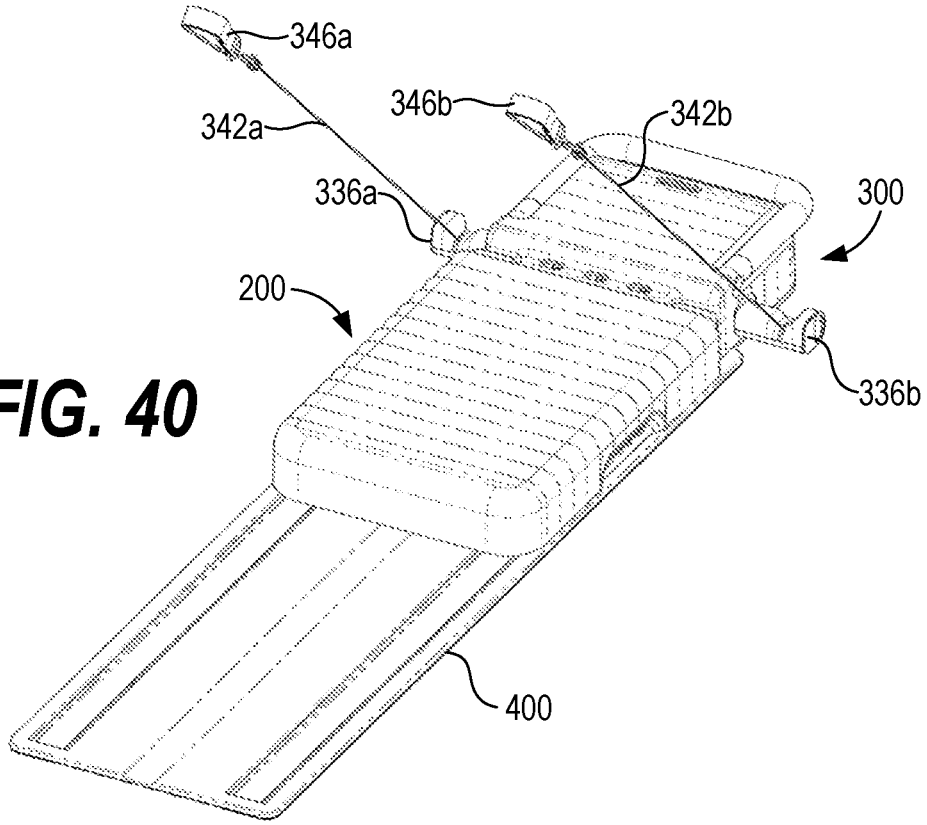

Referring to FIGS. 13 and 14 collectively, the first cable device 327*a* and/or the second cable device 327*b* may include cable extension arms 336*a*, 336*b* (collectively "cable extension arms 336"), spinning cable spools 339*a*, 339*b* (collectively "cable spools 339"), one or more retractable cables 342*a*, 342*b*, cable spool springs, spool bases, and so forth, as may be appreciated. The cable extension arms 336 may be configured to be disposed within a respective platform side 309 such that an end of the cable extension arm 336 is flush with the respective platform side 309. As such, the first cable extension arm 336*a* may be accessible on the first platform side 309*a*, and the second cable extension arm 336*b* may be accessible from the second platform side 309*b*. However, the cable extension arm 336 may be popped or otherwise pulled out of the platform 300, for instance, to expose a hook 345*a*, 345 (collectively "hooks 345") or other fastener having an end of a retractable cable 342 attached therewith. The cable extension arms 336 thus may include side surface apertures 337*a*, 337*b* that enable an individual to place one or two fingers to pull the cable extension arms 336 from being nested within the platform 300 to an external state shown in FIGS. 39 and 40. FIGS. 39 and 40 illustrate handles 346*a*, 346*b* (collectively handles 346") that may be coupled to the hooks 345 in order to do exercises and movements via the handles 346 and retractable cables 342.

The retractable cables 342 may be formed of steel, stainless steel, plastic, rope or other textile, or a combination thereof, and may be stored in a respective cable spool 339. Through the spinning cable spools 339, cable spool springs, and other components, the retractable cables 342 may expand from and retract into the spinning cable spools 339, as may be appreciated. In some embodiments, a level of resistance of retraction of the retractable cables 342 from the spinning cable spools 339 may be adjusted via a resistance selection switch 348, which may provide a predetermined number of resistance levels. In some embodiments, the resistance selection switch 348 is disposed on the top surface 306 of the platform 300, but the resistance selection switch 348 may be placed elsewhere in alternative implementations. In the embodiments shown herein, the retractable cables 342 may provide three adjustable levels of resistance (the resistance selection switch 348 may be adjusted to one of three locations), although other numbers of levels of resistance may be employed in various implementations. To this end, the resistance selection switch 348 may be mechanically coupled to a resistance selector 349 that adjusts resistance of the spinning cable spools 339 (e.g., increasing or decreasing resistance).

Figure 19:
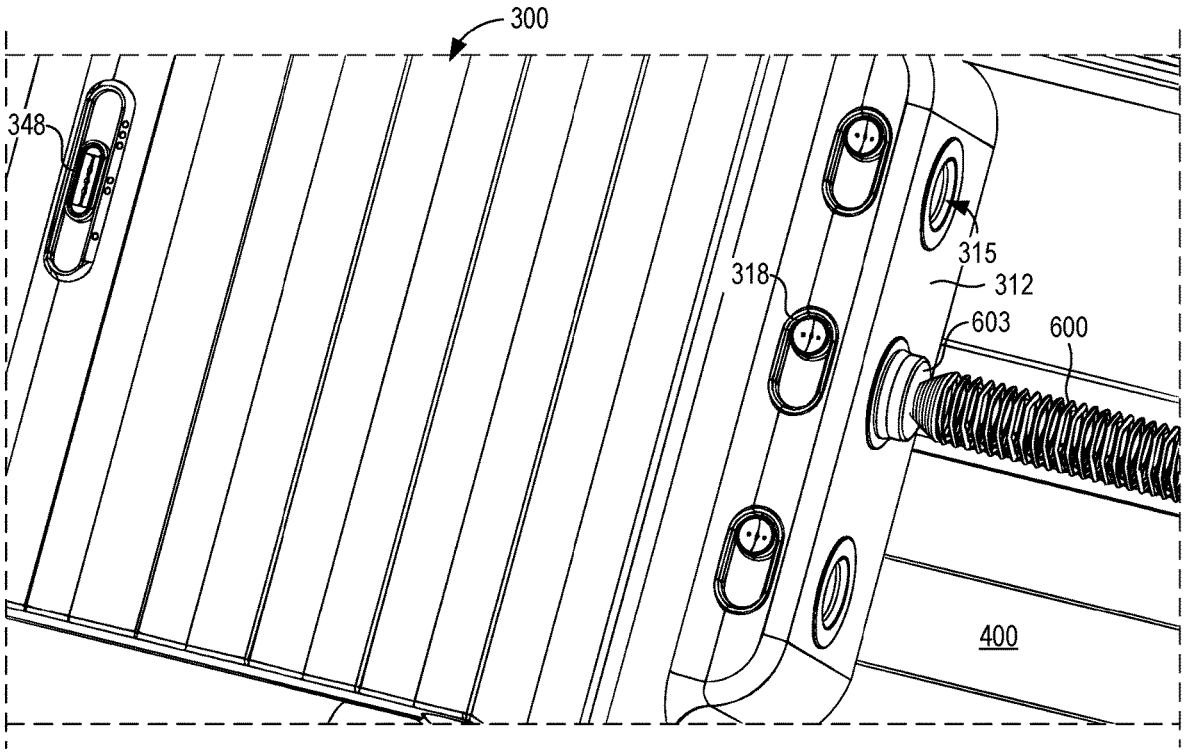

The resistance selection switch 348 may be slidable within a switch recess, as shown in the enlarged view of FIG. 19. The resistance selection switch 348 may be coupled to a member extended downward into an interior of the platform 300, that adjusts a projecting member, thereby tightening or loosening tension in a spring (adjusting resistance of the spinning cable spools 339).

Referring again to the exploded view of the platform 300 shown in FIG. 13, the platform 300 may further include a platform shell 352, a platform bottom 355, an internal platform frame 358, a spool mounting plate 361, and so forth. The spinning cable spools 339 and associated components may be mounted on the spool mounting plate 361 which may be sandwiched between the platform bottom 355 and the internal platform frame 358, and housed within the platform shell 352, as shown in the exploded view of FIG. 13.

Referring collectively to FIGS. 12 and 13, the internal platform frame 358 may include platform tabs 362*a*, 362*b* (collectively "tabs 362"). When assembled, the platform tabs 362 may project from a bottom surface of the platform 300 towards a direction opposite that of the platform front 312. The platform tabs 362 may include L-shaped tabs in some embodiments and may engage with corresponding tabs of the guide mat 400, for instance, to form an interference connection with the guide mat 400. As such, when forces as applied to various components of the exercise system 100 (e.g., during an exercise or other use), the platform 300, and/or the guide mat 400 will remain stationary, providing a consistent direction of motion for the carriage 200, as will be described.

Figure 15:
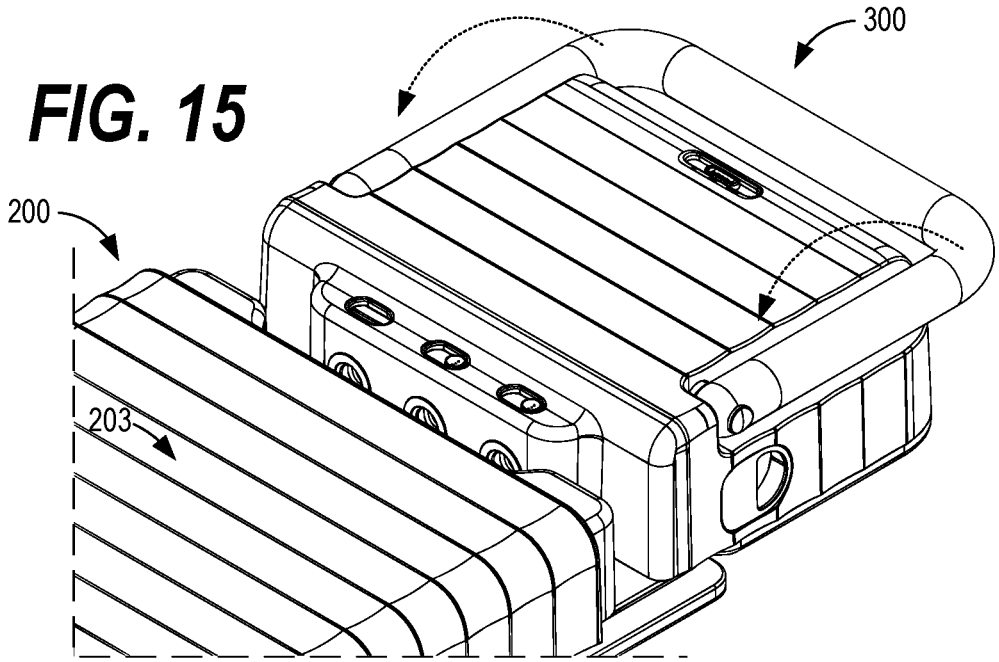
FIGS. 15-19 are various enlarged perspective views of the platform and the carriage shown relative to one another in accordance with various embodiments of the present disclosure.
Figure 16:
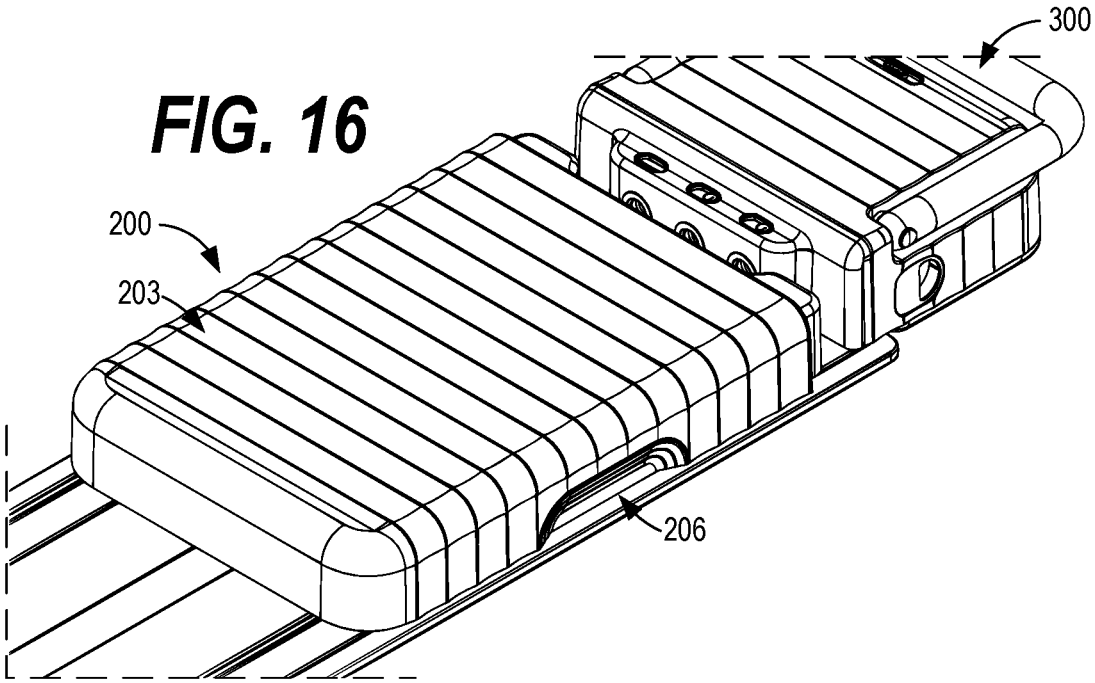
Figure 17:
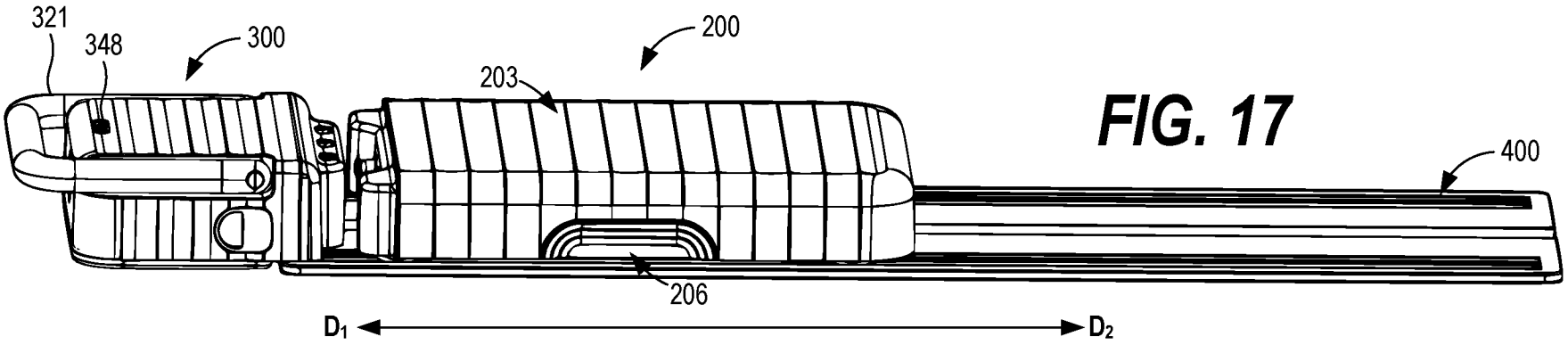
Figure 18:
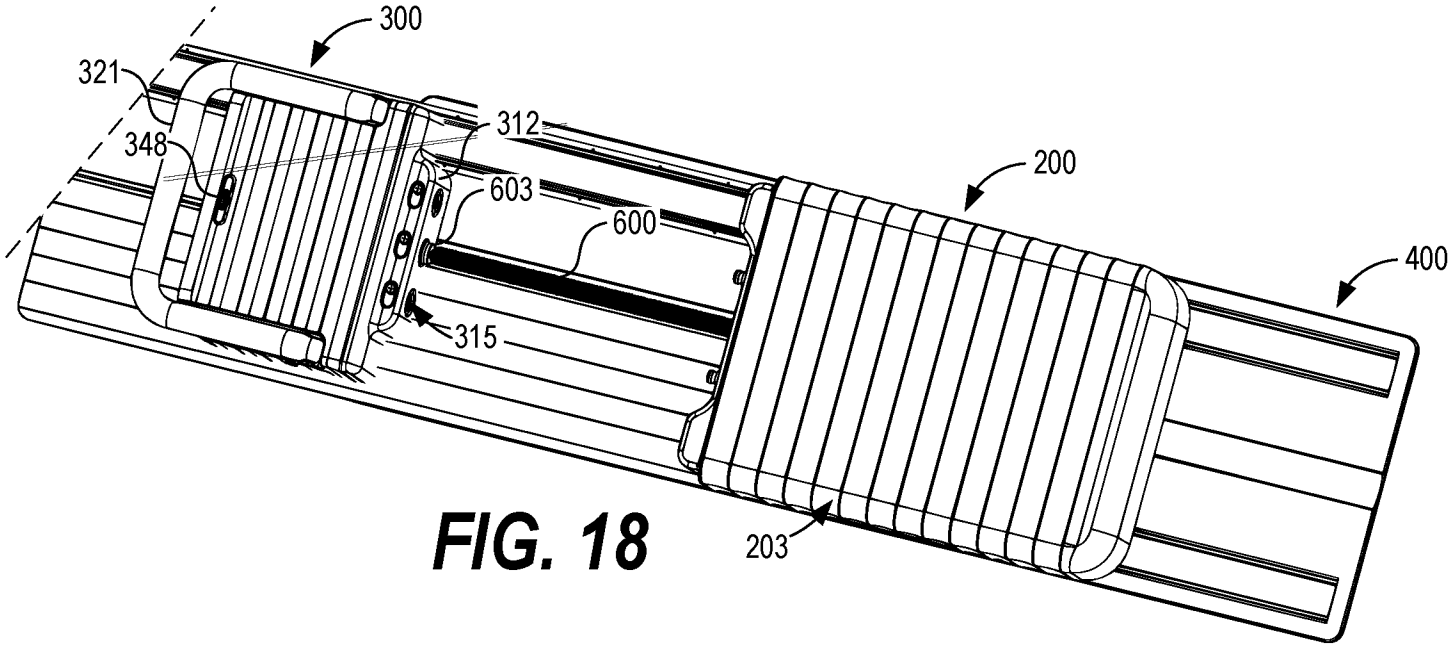
Figure 38:
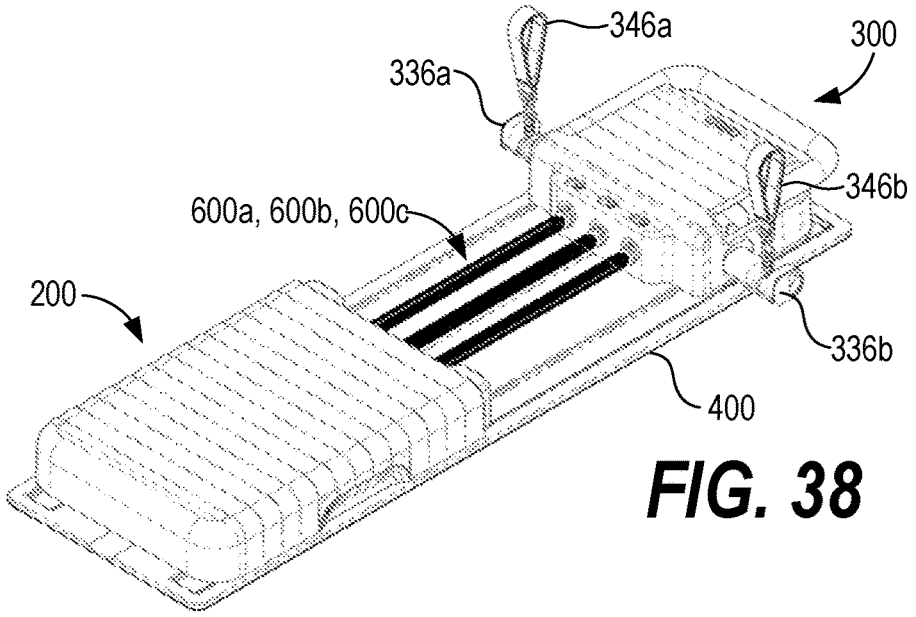
FIGS. 38-42 are top perspective views of an example of an exercise machine in accordance with various embodiments of the present disclosure.

Moving along, FIGS. 15-18 show enlarged perspective views of the carriage 200 positioned relative to the platform 300. In FIGS. 15, 16, and 17, a tension member 600 is not shown as connecting the carriage 200 and the platform 300. FIG. 18, however, shows the tension member 600 coupling the carriage 200 and the platform 300. As the tension member 600 is formed of a stretching or elastic material, the carriage 200 will move relative to the platform 300 (which is stationary). If an exerciser desires to create additional resistance, more tension members 600 can be added or tension members 600 having lower elasticity may be used, as shown in FIG. 38, for example.

The one or more tension members 600 may have a first end coupled to the carriage 200 (e.g., internal to the carriage 200 or at an end of the carriage 200 facing the platform 300) and a second end configured to be coupled to the platform 300 such that, when a connection is formed via the tension members 600, the carriage 200 is movable on a horizontal plane parallel to a ground surface while the platform 300 remains in a fixed position, thereby providing resistance to an exerciser. Again, in some embodiments, one to three tension members 600 may be employed to allow the exerciser to selectively vary a level of resistance required to perform various physical movements and move the carriage 200 relative to the platform 300. In some embodiments, the one or more tension members 600 include elastic or stretchable materials, a spring, or any combination thereof.

While a snap connection may be made between the tension member connector 603 and a platform aperture 315, the tension members 600 may be attached to the platform 300 via various attachment mechanisms positioned on the platform 300, which may include hooks, hook-and-loop fasteners, magnets, or other suitable types of connections. While the tension members 600 are shown as being a part of the carriage 200, in alternative embodiments, the tension members 600 may be part of or stored in the platform 300 (e.g., in a similar, but smaller, arrangement shown with respect to the carriage 200), or may be separate from both the carriage 200 and the platform 300.

Figure 20:
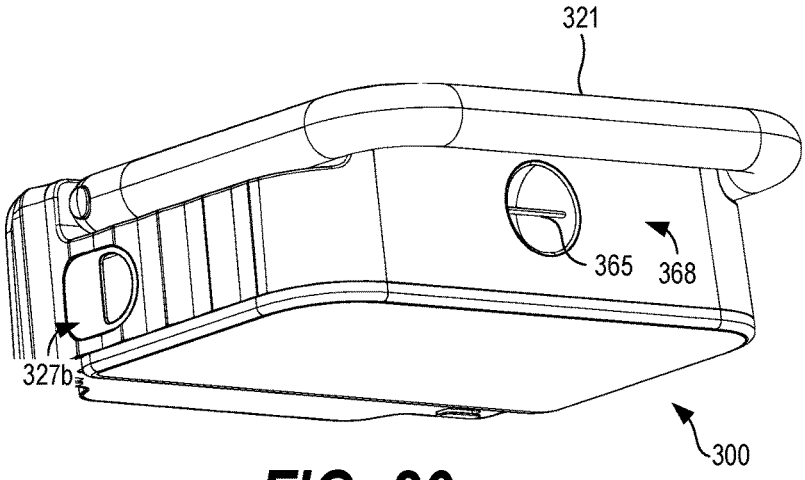
FIG. 20 is a rear perspective view of the platform for use with the exercise machine in accordance with various embodiments of the present disclosure.

In various embodiments, the platform 300 may further include a coupling member 365, as shown in FIG. 20. The coupling member 365 may be positioned on a rear face 368 of the platform 300 in some embodiments. In some embodiments, the coupling member 365 includes a rod having a recessed portion for receiving a bungee cord or other attachment for exercise. To this end, the bungee cord may be fixedly or detachably attached to a front end of the platform 300, although other attachment points may be employed. The bungee cord (not shown) may be formed of an elastic and stretchable material (e.g., an elastic resistance cord), and may include a handle (not shown) in some embodiments.

Referring again to the stowage dock 500, the stowage dock 500 may be operable to store the carriage 200, the platform 300, the accessories associated therewith, and/or other components therein, while facilitating transport. In various embodiments, the stowage dock 500 may store the carriage 200 and the platform 300 therein in a vertical orientation. As shown in FIG. 3, the stowage dock 500 may include an L-shaped body, where the platform 300 may be positioned between the carriage 200 and the L-shaped body of the stowage dock 500. Tabs, locking connectors, magnets, other connection mechanisms, or a combination thereof, may assist with retaining the carriage 200 and the platform 300 in the stowage dock 500.

In some embodiments, the stowage dock 500 may include a mount (not shown) and a display device 555, where the mount is configured to retain at least the display device 555. The display device 555 may include, for example, one or more devices such as liquid crystal display (LCD) displays, gas plasma-based flat panel displays, organic light emitting diode (OLED) displays, electrophoretic ink (E-ink) displays, LCD projectors, touchscreen display devices, or other types of display devices, etc. In some embodiments, the mount includes a plurality of rails (not shown) that engage with corresponding connection mechanisms (e.g., screws, bolts, rails, etc.) of the display device 555 that permits the display device 555 to adjust vertically relative to the ground surface. In other embodiments, a mount with a gas lift and/or a rotating head may be employed. The display device 555 may contain or may be coupled to at least one computing device 558 and/or an imaging device 560 (e.g., a camera) in some embodiments. The display device 555 may include a speaker or other audio emitting device, or the speaker or other audio emitting device may be positioned in another suitable location of the stowage dock 500.

In some embodiments, the exercise system 100 may include one or more sensors 263, 363, and 563 configured to generate measurements responsive to movements of the carriage 200 relative to the platform 300. For instance, sensors 263, 363, and 563 may be positioned in the exercise system 100 components and metrics and measurements may be generated based on resistance levels of the tension members 600, speed of movement of the carriage 200, weight, body heat, or other biometric parameters of the user, and so forth, to estimate calories exerted, and so forth. The sensors 263, 363, and 563 may include, for example, accelerometers, gyroscopes, heart rate sensors, body temperature sensors, and the like. As such, the exercise system 100 may include at least one computing device 558 in communication with the display device 555 and/or the at least one sensor 263, 363, and 563. The at least one computing device 558 may be configured to display information associated with the measurements on the display device 555, as well as present virtual classes and so forth, potentially streamed over a network, such as the Internet. In some embodiments, the exercise system 100 includes at least one camera or other suitable imaging device 560 (e.g., on the platform 300 or the stowage dock 500).

A client device, such as a smartphone, a tablet, a wearable computing device, a laptop computing device, and the like may include at least one hardware processor and memory. The client device may be configured to execute a companion application thereon to access or generate measurements associated with an exerciser utilizing the exercise system 100. The at least one computing device 558 and/or client device may further include memory and program instructions executable by at least one hardware processor of the at least one computing device 558 or client device that, when executed, directs the at least one computing device 558 or client device to stream at least one fitness class associated with the exercise system 100 or components thereof over a network via the display device 555.

As noted above, reformers are generally not portable apparatus and sometimes are required to be fixed to a wall, ground, or other surface. Providing an at-home reformer that permits individuals to perform reformer-type movements is desirable, however, it is difficult to simulate frictionless carriage movements without a having a heavy and bulky multi-rail system. Accordingly, in some embodiments, the exercise system 100 (or system) may include a guide mat 400.

Figure 21:
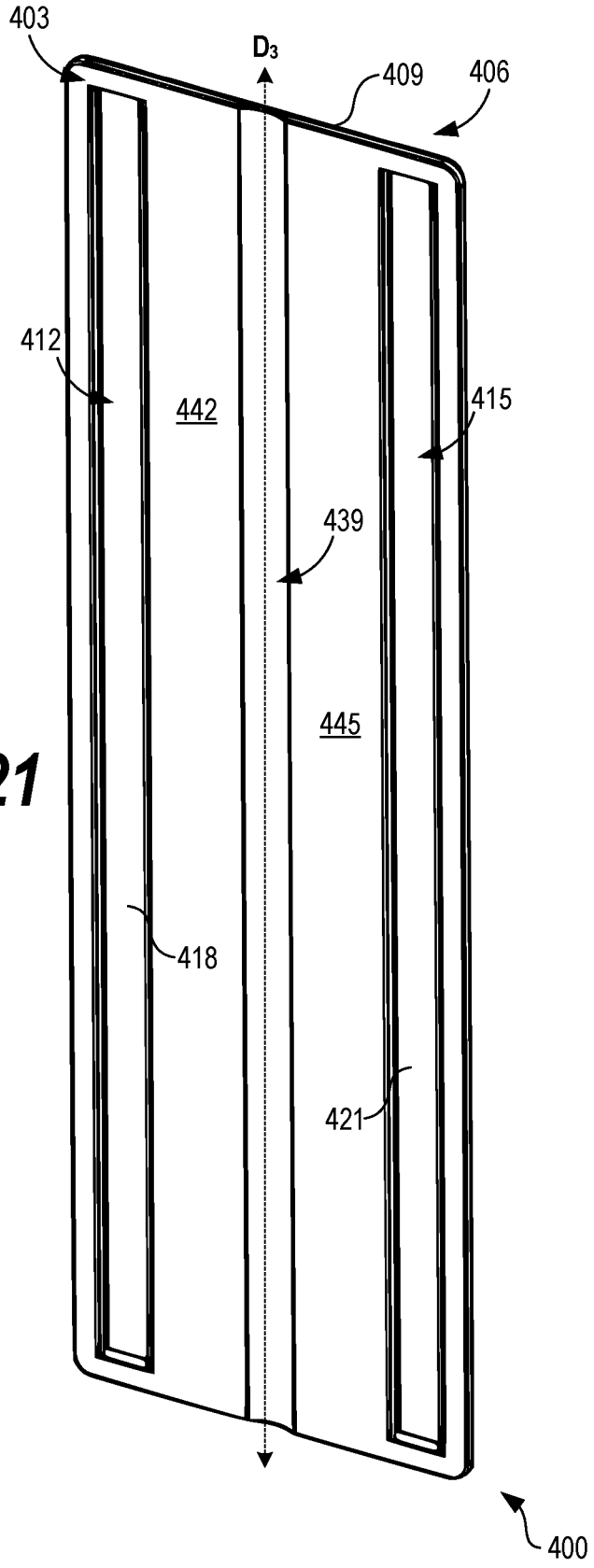
FIGS. 21-28 are various views of a guide mat for use with the exercise machine in accordance with various embodiments of the present disclosure.
Figure 22:
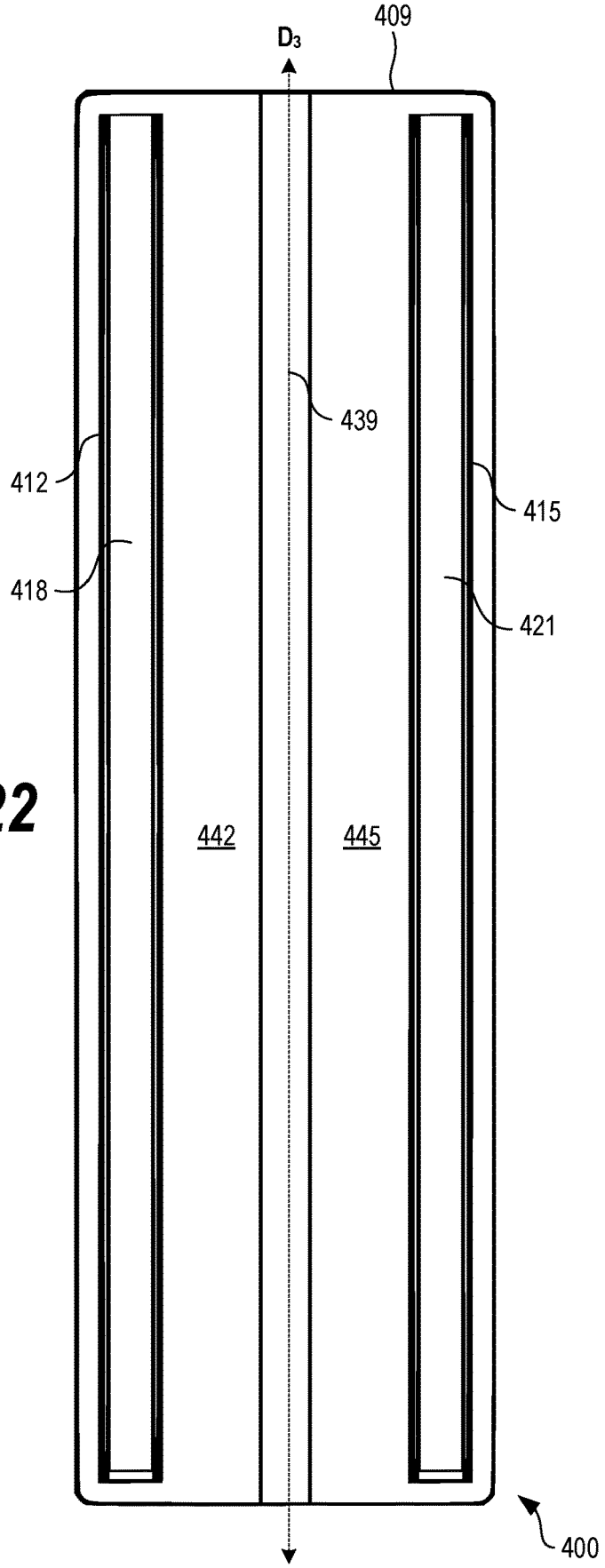
Figure 23:
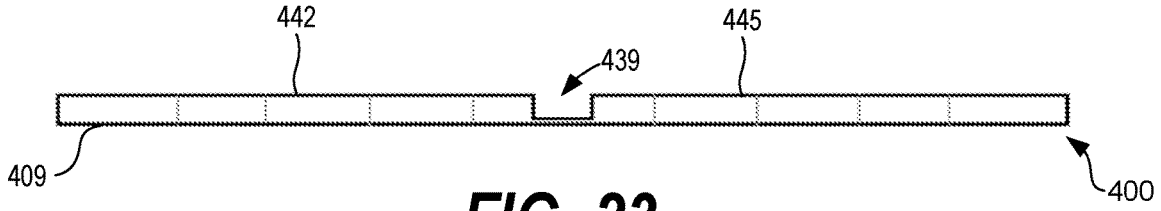
Figure 24:
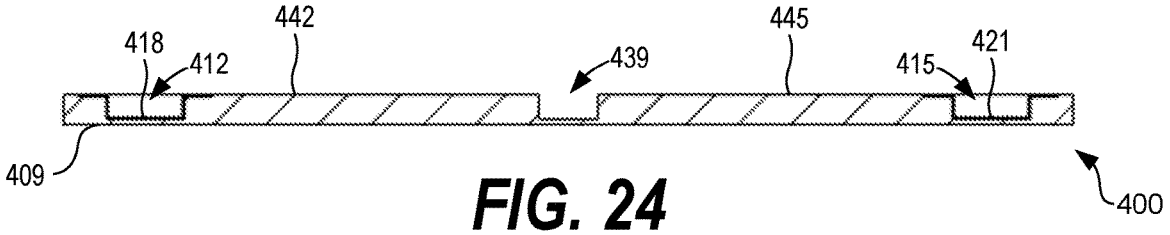

Turning now to the drawings, FIG. 21 is a front perspective view of a guide mat 400 for use with a portable exercise apparatus, FIG. 22 is a front view of the guide mat 400, FIG. 23 is a front view of the guide mat 400 in a slightly folded state, and FIG. 24 is a front view of the guide mat 400 in a fully folded state according to various embodiments of the present disclosure. The guide mat 400 includes a top mat surface 403 and a bottom mat surface 406. The bottom mat surface 406 may be adapted to engage with a ground surface. For example, a body 409 of the guide mat 400 or the bottom mat surface 406 thereof may be formed of a material having a suitable friction coefficient to prevent the guide mat 400 from sliding during exercise movements. In addition to or alternatively, the bottom surface 406 of the guide mat 400 may include bottom-side projections formed of a material that creates friction with a ground surface.

Figure 25:
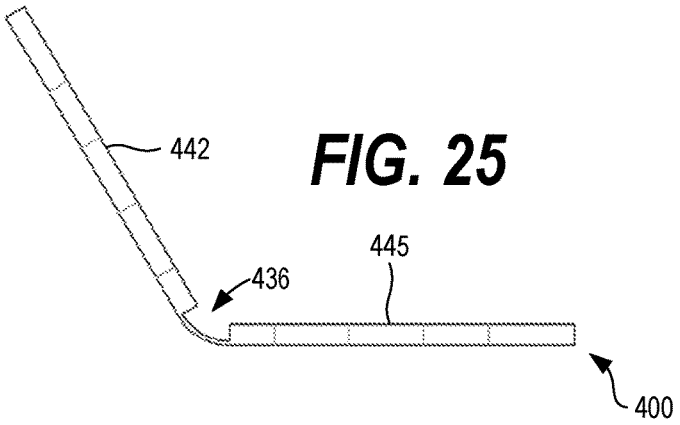
Figure 26:
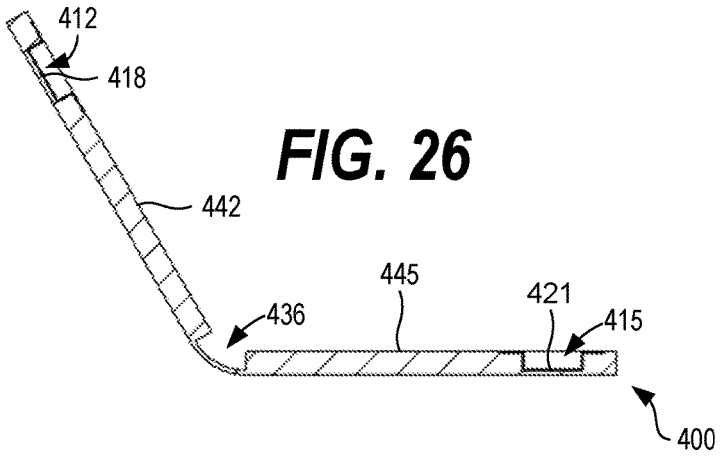
Figure 27:
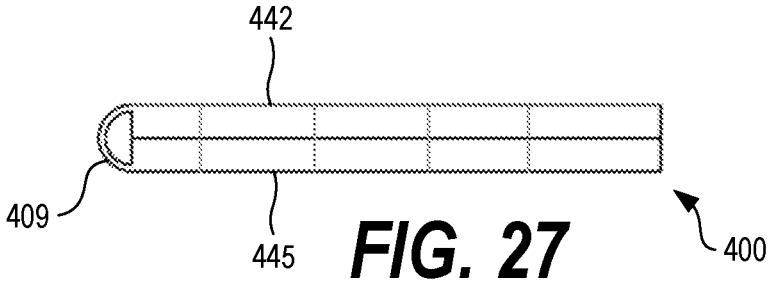
Figure 28:
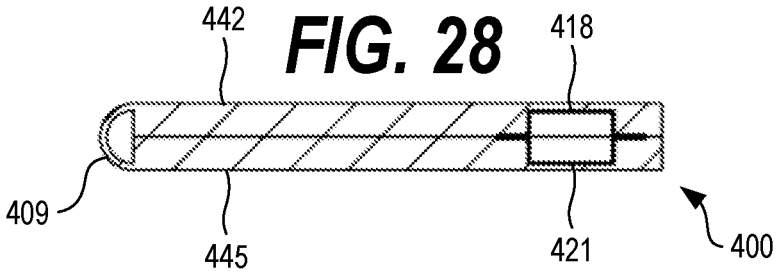
Figure 29:
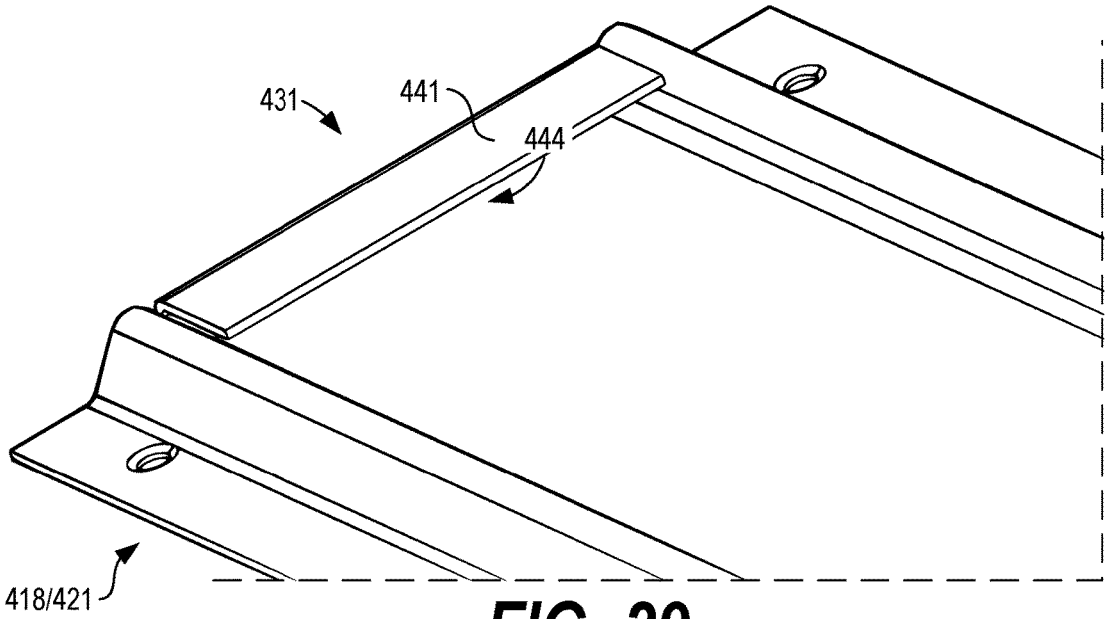
FIGS. 29-30 are bottom views of opposing ends of a track for use with a guide mat in accordance with various embodiments of the present disclosure.
Figure 30:
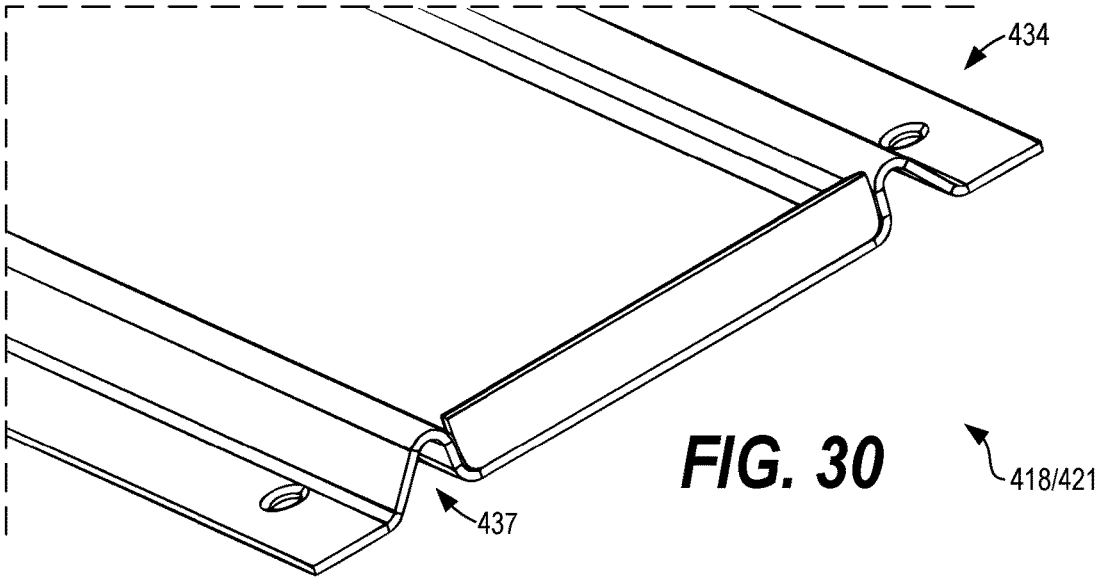
Figure 31:
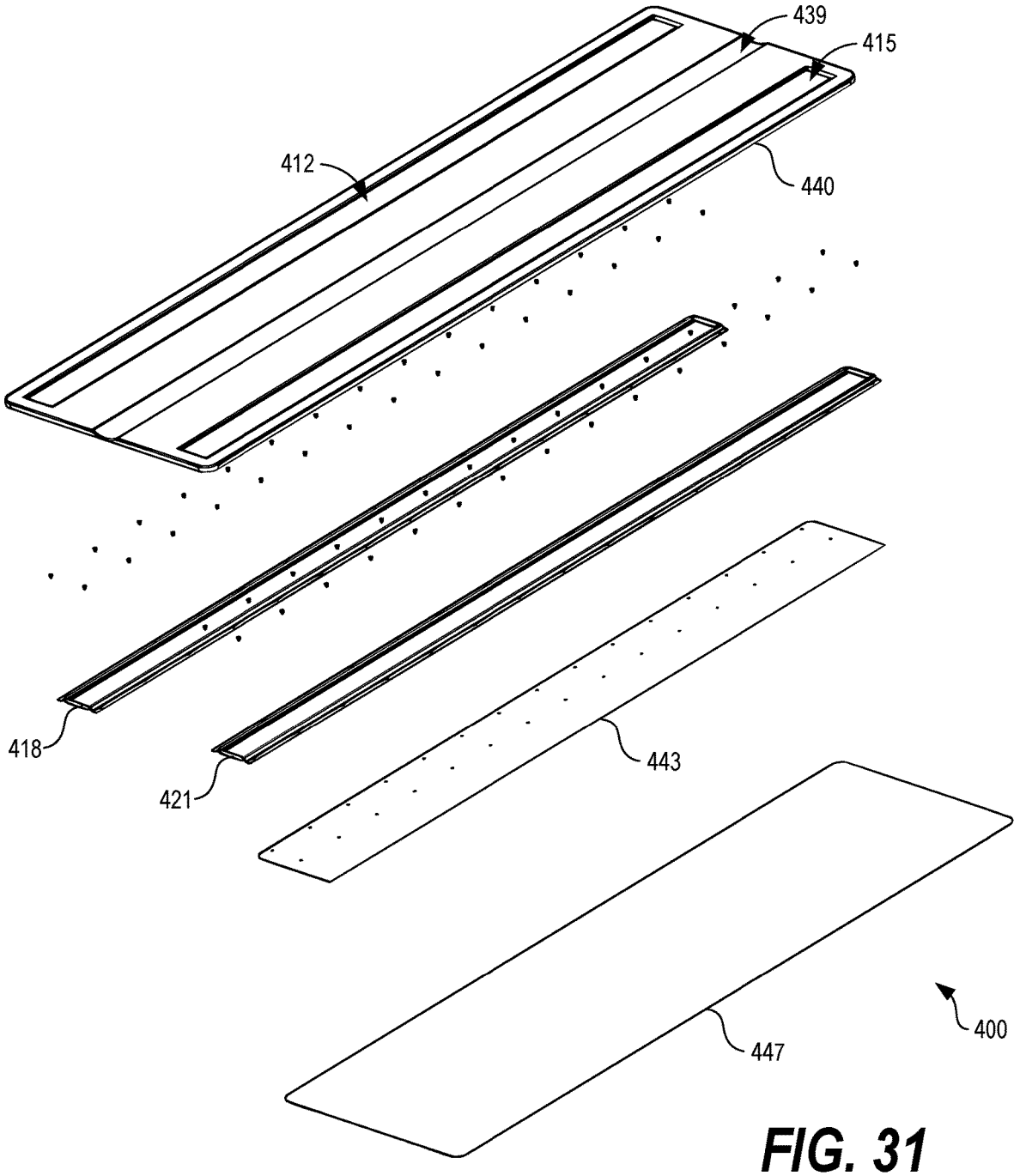
FIG. 31 is an exploded view of the guide mat in accordance with various embodiments of the present disclosure.

FIG. 25 is a top view of the guide mat 400, FIG. 26 is a top cross-section view of the guide mat 400, FIG. 27 is a top view of the guide mat 400 in a slightly folded state, FIG. 28 is a top cross-section view of the guide mat 400 in a slightly folded state, FIG. 29 is a top view of the guide mat 400 in a fully folded state, and FIG. 30 is a top cross-section view of the guide mat 400 in a fully folded state according to various embodiments of the present disclosure. FIG. 31 is an exploded view of an embodiment of the guide mat 400 showing additional components thereof.

Also, referring back to FIGS. 17 and 18, perspective views of the guide mat 400 are shown in use with the exercise system 100. As can be seen in FIGS. 17 and 18, one or more of tension members 600 are shown as being adapted to impose a predetermined force such that the carriage is movable on a horizontal plane parallel to a ground surface while the platform remains stationary in a fixed position. In other words, the carriage 200 can move in a first direction $D_1$ and a second direction $D_2$, substantially along a length of the guide mat 400, for example, or on a ground surface as permitted by elasticity of the one or more tension members 600.

Referring to FIGS. 21-31 collectively, the body 409 of the guide mat 400 may be elongated and rectangular-shaped, thereby extending along a longitudinal axis $D_3$ parallel to the ground surface. It is understood that shapes or variations from the embodiment of FIGS. 21-31 may be employed. In any event, in some embodiments, the guide mat 400 may include a first elongated aperture 412 positioned on a first side of the top mat surface 403 and a second elongated aperture 415 positioned on a second opposing side of the top mat surface 403. In some embodiments, the first elongated aperture 412 and/or the second elongated aperture 415 are rectangular shaped. Further, in some embodiments, the first elongated aperture 412 and/or the second elongated aperture 415 may be encapsulated or, in other words, surrounded on all sides by the body 409 of the guide mat 400. While elongated apertures are described, in some implementations, recesses disposed in the top mat surface 403 may be used in place of the apertures 412, 415.

The guide mat 400 is configured to maintain alignment of the carriage 200, for example, during translation of the carriage 200 relative to the guide mat 400. In other words, the guide mat 400 may guide the carriage 200 and ensure a predetermined path of travel is followed when exercises are performed using the carriage 200, for instance, as the carriage 200 travels between a first proximal end of the guide mat 400 to a second distal end of the guide mat 400 (e.g., from $D_1$ towards $D_2$, and from $D_2$ towards $D_1$). In some embodiments, to ensure alignment, a first track 418 may be positioned in the first elongated aperture 412. The first track 418 may be sized and positioned to retain a first subset of wheels 212 of the carriage 200. Likewise, a second track 421 may be positioned in the second elongated recess aperture. The second track 421 may be sized and positioned to retain a second subset of the wheels 212 (e.g., right-most wheels 212) of the carriage 200. The tracks 418, 421 ensure a directly linear and/or horizontal translation of the carriage 200.

While tracks 418, 421 are described, it is understood that in other implementations, bumper (raised) edges, alternative shaped tracks, and the like may be employed to ensure alignment of the carriage 200 relative to either the guide mat 400 and/or the ground surface through engagement with the wheels 212 or other movement device of the carriage 200. For instance, in some implementations, the tracks 418, 421 may not be recessed or nested in the guide mat 400 as shown in FIGS. 21-28, but instead may project upwards from a top surface of the guide mat 400. In some embodiments, a linear guide or set of linear guides (not shown) may project up from the guide mat 400 or may telescope out from the platform 300. In these scenarios, the carriage 200 would movably couple to the linear guide(s) to move between a proximal end of the linear guide (e.g., an end closest the platform 300) to a distal end of the linear guide (e.g., an end farthest from the platform 300). Other alignments devices may be employed, as can be appreciated.

In various embodiments, the body 409 of the guide mat 400 may include a folding notch 439 extending substantially along the body 409 such that the body 409 of the guide mat 400 is foldable along the folding notch 439. A sequential transition of the folding of the body 409 of the guide mat 400 along the folding notch 439 is shown in FIGS. 23-28, where FIGS. 23 and 24, for example, show the guide mat 400 in a fully expanded state (or an in-use state), FIGS. 25 and 26 show the guide mat 400 in a partially folded state, and FIGS. 24-25 show the guide mat 400 in a fully folded state, as may be appreciated. The guide mat 400 may thus ensure that the carriage 200 does not stray from a predetermined area while maintaining movement in the predetermined area (e.g., within a perimeter or four corners of the guide mat 400). The folding notch 439 may define a first portion 442 of the guide mat 400 and a second portion 445 of the guide mat 400 that are coupled to one another about the folding notch 439 to symmetrically fold (e.g., a hot-dog fold). While a hot-dog fold is described, it is understood that other types of folding of the guide mat 400 may be employed.

In some embodiments, the body 409 is formed of at least one of: synthetic rubber; natural rubber; polyvinyl chloride (PVC); thermoplastic elastomer (TPE); polyurethane (PU); ethylene vinyl acetate (EVA); and jute. Similarly, in some embodiments, the first track 418 and the second track 421 are both formed of a metal, such as at least one of: steel; stainless steel; copper; brass; and aluminum. In some embodiments, the first track 418 and the second track 421 may be lubricated, to facilitate movement of wheels 212 positioned within the first track 418 and the second track 421. While various embodiments describe two tracks (e.g., the first track 418 and the second track 421), in alternative embodiments, a single track or more than two tracks may be employed. Thus, a single recess or more than two recesses may be employed.

The carriage 200 is not limited to the type of the wheels 212 shown in the figures. The wheels 212 may be mounted or otherwise positioned on distal ends of the carriage 200 in some embodiments, and may be nested or partially nested within the body of the carriage 200. The wheels 212 may be selected such that the carriage 200 has as little friction as possible when the wheels 212 are positioned or nested in the first track 418 and/or the second track 421, providing a near frictionless device. In some implementations, the wheels 212 may be substituted with glides (e.g., nylon glides), tank treads, and like devices.

In some embodiments, the body 409 of the guide mat 400 may be formed up of a plurality of connecting pieces using, for example, dovetails connections. However, in alternative embodiments, the body 409 may be a single piece of material and the portions of the body 409 may be integral with one another, where the first track 418 and the second track 421 are separate components (e.g., metal components) that may be inserted into the first elongated aperture 412 and the second elongated aperture 415, thereby forming an interference and/or friction fit with the first elongated aperture 412 and the second elongated aperture 415, respectively. While various embodiments describe the first track 418 and/or the second track 421 being metal, in other implementations, the first track 418 and/or the second track 421 may be formed of wood, plastic, or other suitable material that may retain the wheels 212 or other movement device of the carriage 200, thereby maintaining alignment of the carriage 200.

Turning now to FIGS. 29 and 30, bottom views of opposing ends of a track 418, 421 are shown according to various embodiments. Specifically, FIG. 29 shows a proximal end 431 of a track 418, 421 and FIG. 30 shows a distal end of the track 418, 421. The proximal end 431 may include an end closest to the platform 300 intended during operation, whereas the distal end 434 may include an end further from the platform 300. The tracks 418, 421 include track recesses 437 configured to receive and retain the wheels 212 or other movement device of the carriage 200. The track recesses 437 may be U-shaped or V-shaped and, as such, may be formed by bending a piece of metal or other material.

As shown in FIG. 29, a bottom of the track 418, 421 may include a mat tab 441 extending substantially along a width of the track 418, 421. The mat tabs 441 may be exposed, for instance, on a bottom surface of the guide mat 400. The mat tab 441 may project inward towards the opposing end (the distal end 434) of the track 418, 421, thereby defining an area 444 under the mat tab 441 in which a platform tab 362 may be positioned. The mat tab 441 may engage with and couple to the platform tab 362 that may be positioned on a bottom surface of the platform 300. The coupling between the mat tab 441 and the platform tab 362 may include an interference connection, for example.

Figure 32:
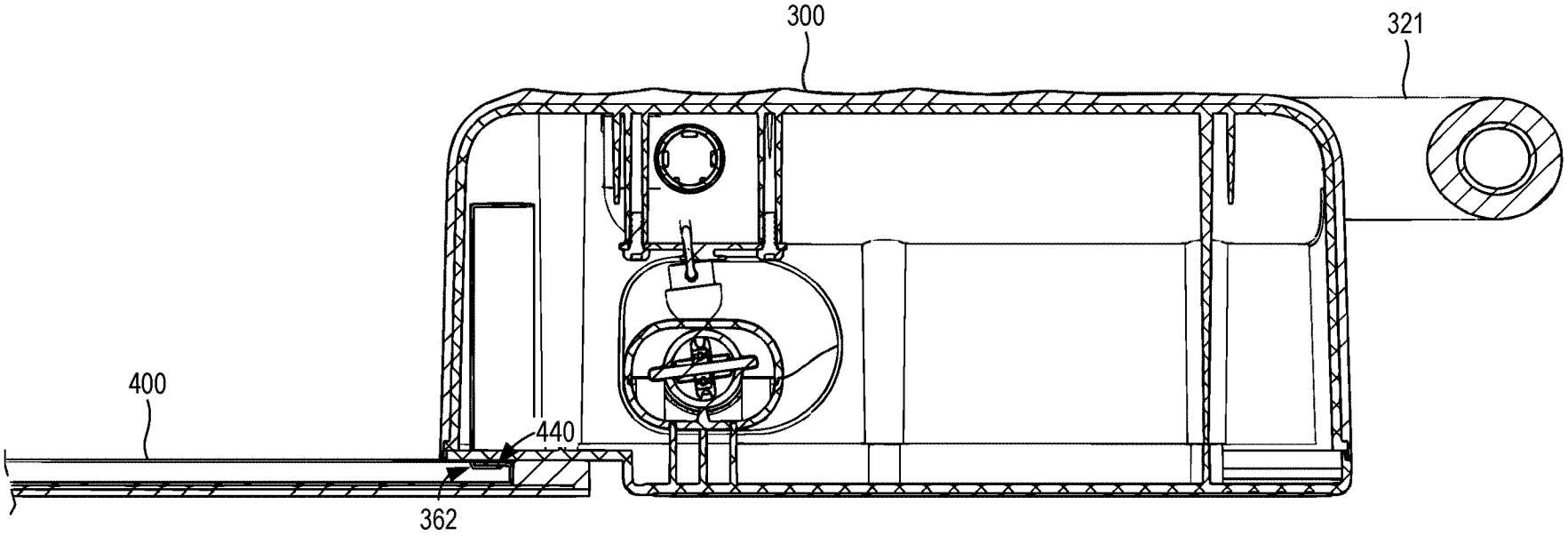
FIGS. 32-34 are side cross-sectional views showing a coupling of the guide mat with the platform in accordance with various embodiments of the present disclosure.
Figure 33:
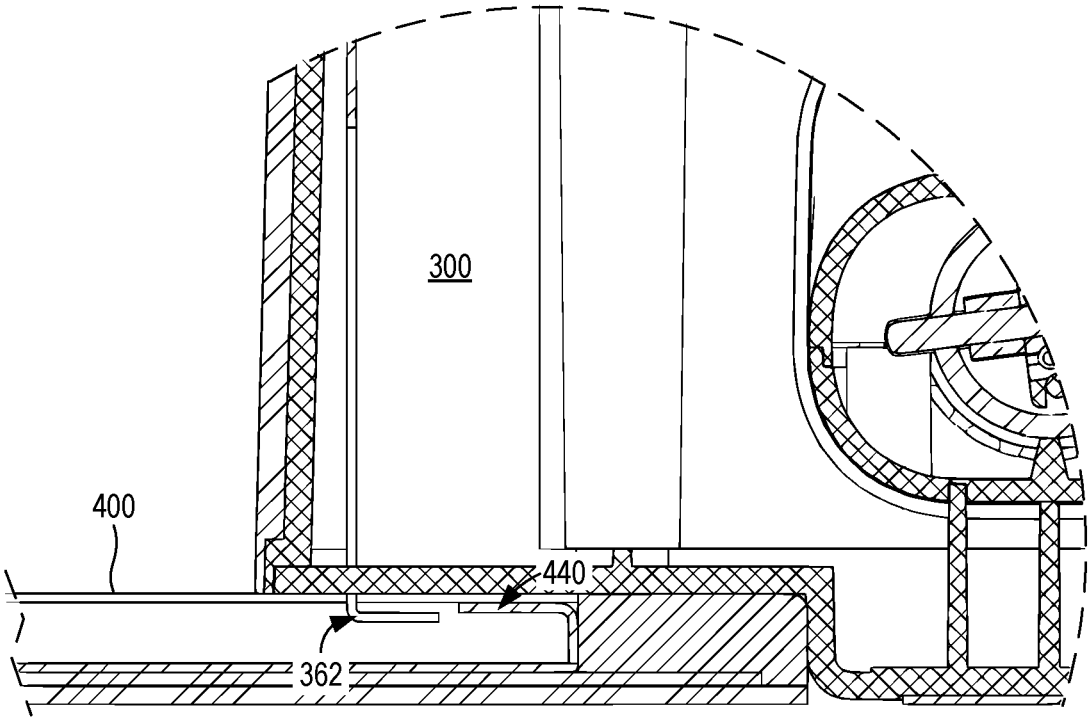
Figure 34:
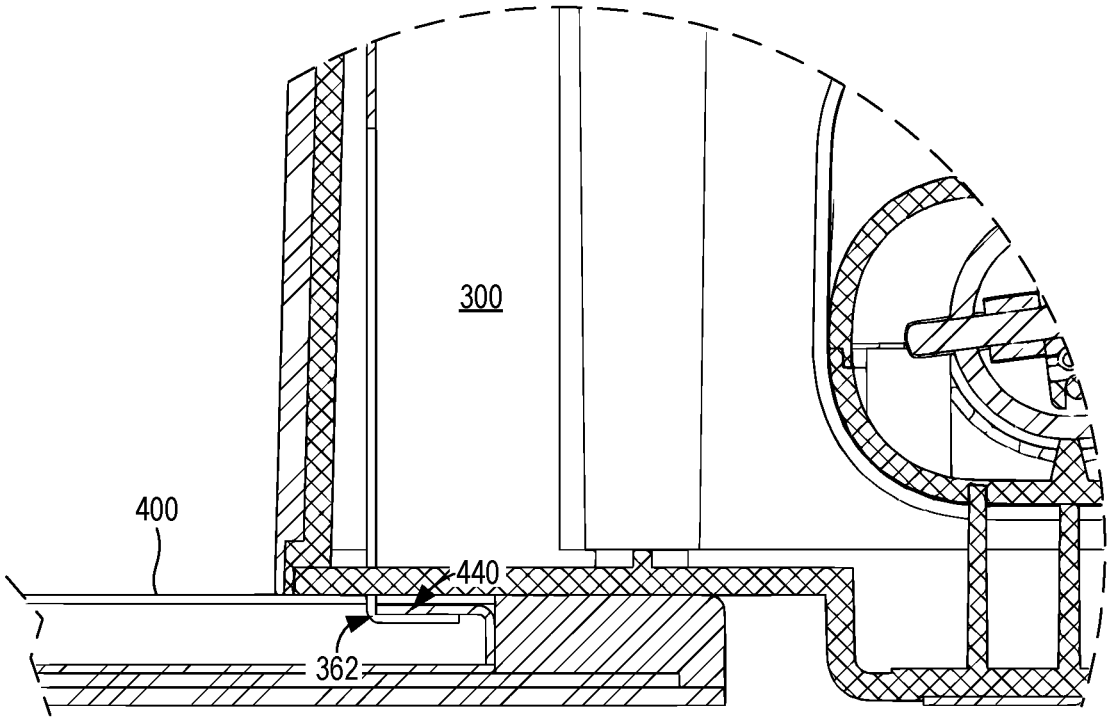

The connections are better shown in the cross-sectional views of FIGS. 32-34, where FIGS. 32 and 34 show a complete connection between the mat tab 441 and the platform tab 362, whereas FIG. 13 shows a removal or other separation of the mat tab 441 from the platform tab 362. Specifically, the first platform tab 362*a* is configured to hook and form an interference connection with the first mat tab 441*a* of the guide mat 400, and the second platform tab 362*b* is configured to hook and form an interference connection with second first mat tab 441*b* of the guide mat 400.

Referring back to the non-limiting example of the guide mat 400 shown in FIG. 31, the guide mat 400 may further include a mat top layer 440, a track base 443, and a mat base 447. To this end, the mat top layer 440, the track base 443, the mat base 447, the first track 418, and the second track 421 may together form the body 409 of the guide mat 400 in some implementations. The track base 443 may retain the first track 418 and the second track 421 in a fixed position, which is further facilitated due to the size and positioning of the first track 418 and the second track 421 relative to the first elongated aperture 412 and the second elongated aperture 415. For instance, the first track 418 and the second track 421 may form an interference or friction connection with the first elongated aperture 412 and the second elongated aperture 415.

Figure 35:
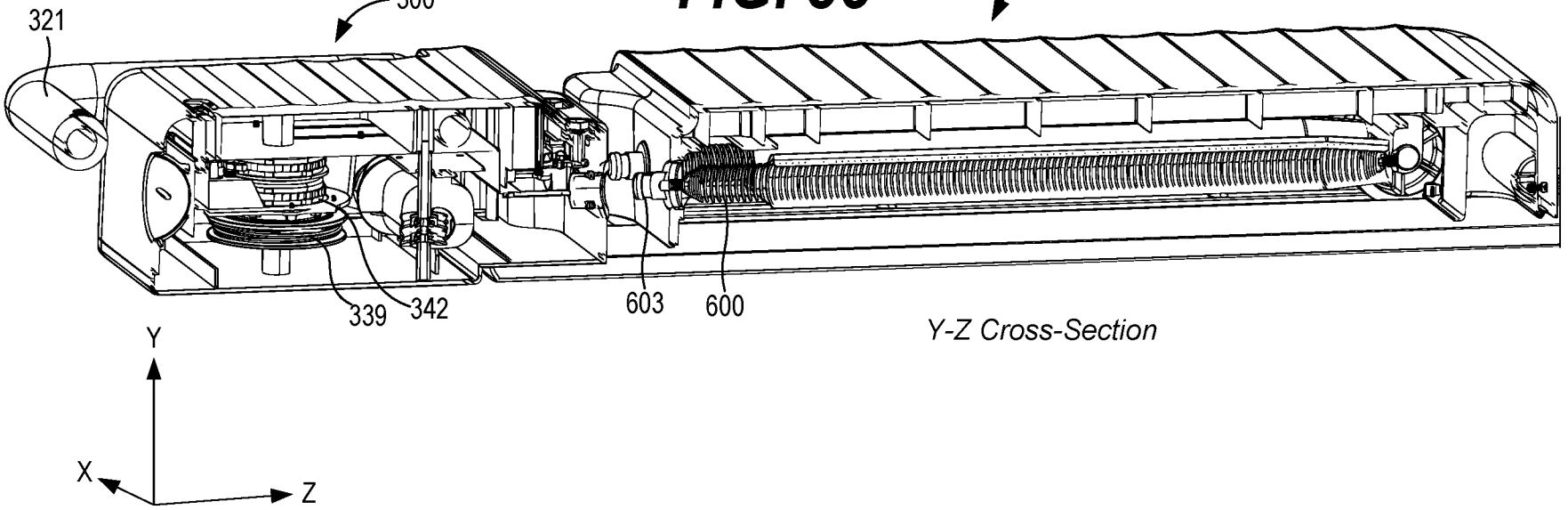
FIG. 35 is a side cross-sectional view of the platform and the carriage in accordance with various embodiments of the present disclosure.
Figure 36:
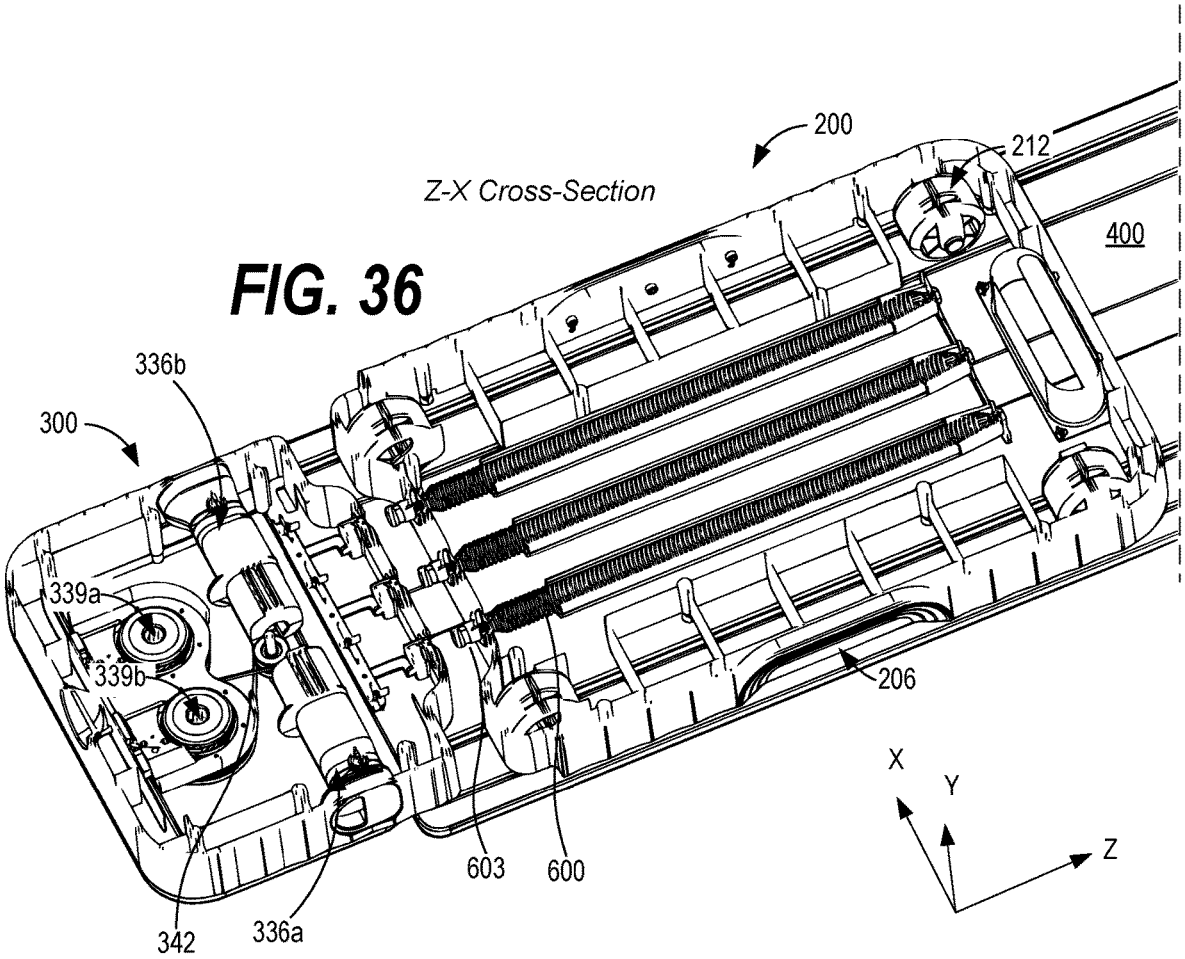
FIG. 36 is a top cross-sectional view of the platform and the carriage in accordance with various embodiments of the present disclosure.

FIG. 35 shows a side cross-sectional view of the exercise system 100 or, more specifically, a Y-Z cross-section of the platform 300 and the carriage 200. Similarly, FIG. 36 shows a top-bottom cross-sectional view of the exercise system 100 or, more specifically, a Z-X cross-section of the platform 300 and the carriage 200. As shown in FIGS. 35 and 36, three tension members 600 are mounted within an interior of the carriage 200 that are detachably attachable to the platform 300. The retractable cable 342 is shown wrapped around the spinning cable spool 339.

The features, structures, or characteristics described above may be combined in one or more embodiments in any suitable manner, and the features discussed in the various embodiments are interchangeable, if possible. In the following description, numerous specific details are provided in order to fully understand the embodiments of the present disclosure. However, a person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, the structure may be integrally formed on the other structure, or that the structure is "directly" disposed on another the other structure, or that the structure is "indirectly" disposed on the other structure through other structures, unless specifically described.

The terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims. The term "at least one" may also be referred to as "one or more."

The terms "first," "second," "third," and so forth are used only as labels, rather than a limitation for a number of the objects. It is understood that if multiple components are shown, the components may be referred to as a "first" component, a "second" component, and so forth, to the extent applicable.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An exercise system, comprising:

a tension member comprising a first end and a second end, the tension member having a tension member connector positioned at the second end of the tension member;

a carriage comprising a plurality of wheels at least partially nested within a body of the carriage, the carriage comprising a front face having the tension member connector positioned thereon, wherein at least a portion of the tension member is at least partially disposed underneath or within an interior of the carriage, and the first end of the tension member is fixedly attached to the carriage; and a stationary platform independent of and separate from the carriage, wherein the stationary platform comprises a front face having a platform aperture, wherein the tension member connector at the second end of the tension member is configured to couple to the platform aperture such that the carriage is movable relative to the stationary platform.

2. The exercise system according to claim 1, wherein the stationary platform comprises a release switch configured to dislodge a coupling between the tension member connector and the platform aperture.

3. The exercise system according to claim 1, wherein the stationary platform further comprises a handlebar pivotable with respect to a handlebar pivot point.

4. The exercise system according to claim 1, wherein the stationary platform further comprises a plurality of platform tabs projecting from a bottom surface of the stationary platform towards a direction opposite that of the front face.

5. The exercise system according to claim 4, further comprising a guide mat comprising a plurality of tabs or apertures, the plurality of platform tabs being configured to engage with the plurality of tabs or apertures of the guide mat to form a connection between the stationary platform and the guide mat.

6. The exercise system according to claim 5, wherein the guide mat comprises a first track thereon configured to retain a first portion of the plurality of wheels, and a second track thereon configured to retain a second portion of the plurality of wheels, the carriage being movably coupled to the guide mat.

7. The exercise system according to claim 1, further comprising a coupling member positioned on a rear face of the stationary platform, the coupling member comprising a rod and a recessed portion for receiving an attachment for exercise.

8. An exercise system, comprising:

a carriage movable between a first position to a second position, the carriage having a rectangular-shaped body with a width suitable to support an individual laying thereon;

a tension member comprising a tension member connector configured to couple to the carriage; and a stationary platform independent of and separate from the carriage, the stationary platform comprising a platform connector configured to couple to the tension member connector to form a tensioned coupling between the carriage and the stationary platform, wherein the stationary platform further comprises a release switch configured to dislodge the tension member connector from the platform connector;

wherein the tension member is adapted to impose a tensioning force such that the carriage is movable on a horizontal plane parallel to a ground surface while the stationary platform remains in a fixed position.

9. The exercise system according to claim 8, wherein the stationary platform has a width the same or substantially same to that of the carriage.

10. The exercise system according to claim 8, wherein the platform connector is a platform aperture, the tension member is one of a plurality of tension members, and each of the plurality of tension members comprises an elongated elastic body configured to deliver the tensioning force.

11. The exercise system according to claim 8, wherein:

the tension member connector comprises a base and an extending member extending from the base, and the base has a diameter greater than that of the extending member; and the extending member comprises an annular recess that couples the extending member to a cord tip, and the stationary platform comprises a projection that is configured to engage the annular recess, thereby maintaining a connection between the stationary platform and the carriage via the tension member.

12. The exercise system according to claim 8, wherein the stationary platform further comprises a coupling member positioned on a rear face of the stationary platform opposite of a side facing the carriage, the coupling member being a rod having a recessed portion for receiving an attachment device.

13. The exercise system according to claim 8, wherein:

the carriage further comprises a plurality of wheels; and the exercise system further comprises a guide mat, the guide mat comprising a first track configured to retain a first portion of the plurality of wheels of the carriage and a second track configured to retain a second portion of the plurality of wheels of the carriage, the carriage being movably coupled to the guide mat.

14. The exercise system according to claim 8, wherein a top surface of the carriage and the stationary platform is formed of a material that provides friction during exercise.

15. An exercise system, comprising:

a carriage movable between a first position to a second position, the carriage having a rectangular-shaped body with a width suitable to support an individual laying thereon;

a tension member comprising a tension member connector configured to couple to the carriage; and a stationary platform independent of and separate from the carriage, the stationary platform comprising a platform connector configured to couple to the tension member connector to form a tensioned coupling between the carriage and the stationary platform, wherein the stationary platform further comprises a coupling member positioned on a rear face of the stationary platform opposite of a side facing the carriage, the coupling member being a rod having a recessed portion for receiving an attachment device;

wherein the tension member is adapted to impose a tensioning force such that the carriage is movable on a horizontal plane parallel to a ground surface while the stationary platform remains in a fixed position.

16. An exercise system, comprising:

a carriage comprising a plurality of wheels that is movable between a first position to a second position, the carriage having a rectangular-shaped body with a width suitable to support an individual laying thereon;

a tension member comprising a tension member connector configured to couple to the carriage;

a stationary platform independent of and separate from the carriage, the stationary platform comprising a platform connector configured to couple to the tension member connector to form a tensioned coupling between the carriage and the stationary platform; and a guide mat, the guide mat comprising a first track configured to retain a first portion of the plurality of wheels of the carriage and a second track configured to retain a second portion of the plurality of wheels of the carriage, the carriage being movably coupled to the guide mat;

wherein the tension member is adapted to impose a tensioning force such that the carriage is movable on a horizontal plane parallel to a ground surface while the stationary platform remains in a fixed position.

17. The exercise system according to claim 16, wherein a body of the guide mat comprises a folding notch extending substantially along the body such that the body of the guide mat is foldable along the folding notch.

18. The exercise system according to claim 17, wherein:

the guide mat comprises a proximal end and a distal end, the stationary platform configured to be positioned at the proximal end;

the first track comprises a first mat tab exposed on a bottom surface of the guide mat, and the second track comprises a second mat tab exposed on the bottom surface of the guide mat; and the first mat tab and the second mat tab both project inwards towards a distal end of the guide mat.

19. The exercise system according to claim 18, wherein the stationary platform comprises a first platform tab and a second platform tab projecting from a bottom surface of the stationary platform towards a direction opposite that of a front of the stationary platform.

20. The exercise system according to claim 19, wherein the first platform tab is configured to hook and form an interference connection with the first mat tab of the guide mat, and the second platform tab is configured to hook and form an interference connection with the second mat tab of the guide mat.

21. The exercise system according to claim 20, further comprising a linear guide that projects from the guide mat or telescopes from the stationary platform, wherein the carriage is movably coupled to the linear guide to move between a proximal end of the linear guide to a distal end of the linear guide and in return.

* * * * *